US008082915B2

(12) United States Patent
McCormick et al.

(10) Patent No.: US 8,082,915 B2
(45) Date of Patent: Dec. 27, 2011

(54) PELLET STOVE

(75) Inventors: Colin J. McCormick, Kettle Falls, WA (US); Daniel S. Henry, Kettle Falls, WA (US); Matthew Wicks, Colville, WA (US); Gordon E. Taylor, Laurier, WA (US)

(73) Assignee: HNI Technologies Inc., Muscatine, IA (US)

( * ) Notice: Subject to any disclaimer, the term of this patent is extended or adjusted under 35 U.S.C. 154(b) by 48 days.

(21) Appl. No.: 12/414,475

(22) Filed: Mar. 30, 2009

(65) Prior Publication Data

US 2009/0183659 A1 Jul. 23, 2009

Related U.S. Application Data

(62) Division of application No. 11/683,970, filed on Mar. 8, 2007, now abandoned.

(60) Provisional application No. 60/780,433, filed on Mar. 8, 2006.

(51) Int. Cl.
*F23B 13/04* (2006.01)

(52) U.S. Cl. ..... 126/73; 126/107; 126/146; 126/161; 126/500; 126/502; 110/185; 110/255; 110/267

(58) Field of Classification Search ..... 126/73, 126/500–502, 527, 532–535, 242–245, 155, 126/107, 146, 161; 110/185, 255, 267, 165 R
See application file for complete search history.

(56) References Cited

U.S. PATENT DOCUMENTS

| | | | | |
|---|---|---|---|---|
| 1,841,210 | A | 1/1932 | Russell | |
| 2,380,000 | A * | 7/1945 | Walton et al. | 126/73 |
| 2,399,490 | A | 4/1946 | Lange | |
| 3,396,706 | A | 8/1968 | Rayburn | |
| 3,706,445 | A | 12/1972 | Gentry | |
| 4,042,160 | A | 8/1977 | Ickes | |

(Continued)

FOREIGN PATENT DOCUMENTS

WO WO 0184048 A1 11/2001

OTHER PUBLICATIONS

International Search Report and Written Opinion of the International Search Authority for PCT/US07/63629, mailed Apr. 18, 2008.

*Primary Examiner* — Steven B McAllister
*Assistant Examiner* — Avinash Savani
(74) *Attorney, Agent, or Firm* — Faegre & Benson LLP

(57) ABSTRACT

According to embodiments of the present invention, a pellet stove includes a firepot assembly with a bottom plate slideable along rails to move between a closed position during combustion in the firepot and an open position during ash removal. According to other embodiments, a firebox or combustion enclosure includes a plurality of airfoils formed on the inner and outer surfaces of the enclosure to facilitate heat exchange between exhaust gases flowing across the inner surface of the enclosure and air blown across the outer surface of the enclosure. According to some embodiments, the airfoils and enclosure are of integral unibody construction. According to yet other embodiments, a user sets parameters via a wall control unit, and a stove control unit receives the parameters and automatically controls fuel feed rate, ignition, convection blower, combustion blower, and/or firepot cleaning based on the one or more parameters.

15 Claims, 26 Drawing Sheets

U.S. PATENT DOCUMENTS

| | | | | | |
|---|---|---|---|---|---|
| 4,143,638 | A | | 3/1979 | Kamstra et al. | |
| 4,147,153 | A | | 4/1979 | Buckner | |
| 4,374,515 | A | * | 2/1983 | Conrad | 126/502 |
| 4,807,589 | A | * | 2/1989 | Johnson | 126/518 |
| 5,000,100 | A | | 3/1991 | Mendive et al. | |
| 5,582,117 | A | | 12/1996 | Mendive et al. | |
| 6,588,049 | B2 | * | 7/2003 | Sundgaard | 15/317 |
| 6,830,000 | B2 | | 12/2004 | Mendive et al. | |
| 2002/0083944 | A1 | | 7/2002 | Darbonne | |
| 2004/0200394 | A1 | * | 10/2004 | Krumrei | 110/347 |
| 2005/0208445 | A1 | * | 9/2005 | Walker et al. | 431/153 |
| 2007/0068511 | A1 | * | 3/2007 | Bachinsky et al. | 126/506 |

* cited by examiner

PELLET STOVE

CROSS-REFERENCE TO RELATED APPLICATIONS

This application is a divisional of U.S. patent application Ser. No. 11/683,970, filed on Mar. 8, 2007, and entitled, "Pellet Stove," which claims the benefit of U.S. Provisional Patent Application Ser. No. 60/780,433, filed on Mar. 8, 2006, and entitled, "Pellet Stove," both of which are incorporated herein by reference in their entirety for all purposes.

TECHNICAL FIELD

Embodiments of the present invention relate generally to systems and methods for heating buildings, and more specifically to pellet stove design and control.

BACKGROUND

A pellet stove is a type of biofuel stove that burns biomass in the form of pellets to generate heat. Pellet stoves can burn corn kernels, wood pellets, cherry pits, and other types of biomass solid fuel. Pellet stoves became popular during the oil shortages of the 1970s. Over time, pellet stoves have become more sophisticated, and more aesthetically pleasing. Most stoves are now quite attractive, and are often used in homes. Commercial models are available, which can heat large buildings or generate electricity.

However, current pellet stoves often generate high levels of noise due to noisy blowers and/or turbulent flow of blown air through pellet stove components. Current pellet stoves often feature limited user interfaces and limited automated controls, which may lead to more work and less choice for the user in cleaning and maintenance operations, for example. Current pellet stoves can often be expensive or complicated to manufacture, they often run at a relatively low efficiency, and may often be unable to burn low grade fuel or one hundred percent corn fuel, for example. Therefore, there is a need in the art for improved pellet stove design and control.

BRIEF SUMMARY

Embodiments of the present invention relate generally to systems and methods for heating buildings, and more specifically to pellet stove design and control. A firepot assembly according to embodiments of the present invention includes a combustion enclosure for housing a solid fuel during combustion, which has a top opening to receive the solid fuel and a bottom opening through which the solid fuel (e.g. ash) may be released after combustion. Such a firepot assembly further includes two rails over which slides a bottom plate between a closed position in which the bottom plate substantially covers the bottom opening of the firepot and an open position in which the bottom plate does not cover the bottom opening, according to embodiments of the present invention. In addition, the firepot assembly may include a motor coupled to the bottom plate and configured to move the bottom plate between the closed position and the open position.

In some cases, the opening on the bottom of the firepot includes a bottom opening and a partial side opening, and the bottom plate includes a substantially flat portion configured to abut the bottom opening and a ramped portion configured to abut the partial side opening. Embodiments of the firepot assembly may further include a controller communicably coupled to the motor and which is configured to activate the motor at predetermined time intervals, or which is configured to receive information about the solid fuel, calculate a cleaning interval based on the information, and activate the motor after the cleaning interval based on calculation. According to some embodiments, the motor includes a drive shaft which extends through a crank arm having a cam roller, and the firepot assembly further includes a lever arm pivotally mounted to a stationary pivot bracket; the lever arm may include a channel at a distal end for receiving the cam roller, and a proximate end of the lever arm may be pivotally connected to a plow arm coupled to a lower surface of the bottom plate, such that actuation of the crank arm causes the lever arm to pull the plow arm and move the bottom plate to the open position.

A firebox for exchanging heat in a pellet stove according to embodiments of the present invention includes an enclosure with side walls, a back wall, and a thermally conductive top wall which is at least partially slanted with respect to the back wall, the enclosure at least partially enclosing a combustion site. Such embodiments of a firebox further include a plurality of thermally conductive airfoils formed on an inner surface of the thermally conductive top wall and another plurality of thermally conductive airfoils formed on an outer surface of the thermally conductive top wall, the first plurality of thermally conductive airfoils being configured to absorb heat from the combustion site via convection, and the second plurality of thermally conductive airfoils being configured to receive the heat via conduction from the first plurality of thermally conductive airfoils through the top wall and impart the heat via convection to a fluid surrounding the second plurality of thermally conductive airfoils. According to some embodiments of the present invention, the back wall is a thermally conductive back wall, and the firebox further includes a third plurality of thermally conductive airfoils formed on an inner surface of the thermally conductive back wall and a fourth plurality of thermally conductive airfoils formed on an outer surface of the thermally conductive back wall; the third plurality of thermally conductive airfoils being configured to absorb the heat from the combustion site via convection, and the fourth plurality of thermally conductive airfoils being configured to receive the heat via conduction from the third plurality of thermally conductive airfoils through the back wall and impart the heat via convection to a fluid surrounding the fourth plurality of thermally conductive airfoils.

According to such embodiments of the present invention, the firebox may further include a convection blower configured to blow air over the plurality of airfoils on the outer surface of the top wall. Each airfoil of the plurality of thermally conductive airfoils may include a leading edge, a trailing edge narrower than the leading edge, a base, and a tip which is narrower than the base, and each such airfoil may be configured to permit laminar air flow over each airfoil. The firebox according to embodiments of the present invention may further include a fuel opening through which a fuel passes from an outside of the enclosure to the combustion site and an exhaust opening through which exhaust gases pass from the combustion site to the outside; in some cases, a one-piece hopper may be positioned at least partially over the top wall and configured to hold the fuel, and a chute may connect the hopper with the fuel opening. The airfoils, the top wall, the back wall, and/or the side walls may be formed integrally as a unibody construction, according to embodiments of the present invention.

A pellet stove control system according to embodiments of the present invention includes a wall control unit with a user interface through which a user sets one or more parameters related to operation of the pellet stove and a stove control unit communicably coupled with the wall control unit, the stove control unit configured to receive the one or more parameters from the wall control unit and automatically control fuel feed rate, ignition, convection blower, combustion blower, and/or firepot cleaning of the pellet stove, based at least in part on the one or more parameters. The one or more parameters may include temperature, time of day, day of week, fuel type, automatic mode, and/or manual mode. The stove control unit may include a machine-readable medium containing instructions executable by the stove control unit to feed a predetermined amount of biomass fuel into the firepot, ignite the biomass fuel, start the combustion blower, detect a flame for the biomass fuel, and based at least in part on the detection of the flame, feed additional amounts of the biomass fuel into the firepot at an increasing rate while concurrently increasing a speed of the combustion blower until a predetermined heat output is achieved. The machine-readable medium may also include instructions executable by the stove control unit to receive information about a fuel type, determine a cleaning frequency based on the fuel type, initiate an auto clean process based on the cleaning frequency, re-ignite the fuel.

The pellet stove control system may also include a memory which stores parametric data for one or more fuel types, the parametric data including without limitation: feed rate, auger speed, combustion fan speed, minimum temperature during burn, maximum temperature during burn, soft start low feed speed, soft start feed speed, soft start feed time, soft start blower speed, rise temperature during soft start, pot temperature after soft start, maximum number of ignition retries, auto clean pulse interval, start up feed charge speed, ignition time, snapshot time, snapshot temperature rise differential, cool down time, start up vacuum test combustion blower speed, start up ignition combustion blower speed, shutdown combustion blower speed, vacuum pressure threshold, drop tube maximum temperature, and power table data. Embodiments of the present invention may also include a Peltier module configured to produce and store an electrical charge with heat generated by the pellet stove, and which may be used at least partially to power the stove control unit.

This summary provides only a general outline of some embodiments of the present invention. Many other objects, features, advantages and other embodiments of the present invention will become more fully apparent from the following detailed description and the accompanying drawings.

BRIEF DESCRIPTION OF THE DRAWINGS

A further understanding of the various embodiments of the present invention may be realized by reference to the figures which are described in remaining portions of the specification.

DETAILED DESCRIPTION

Figure 1:
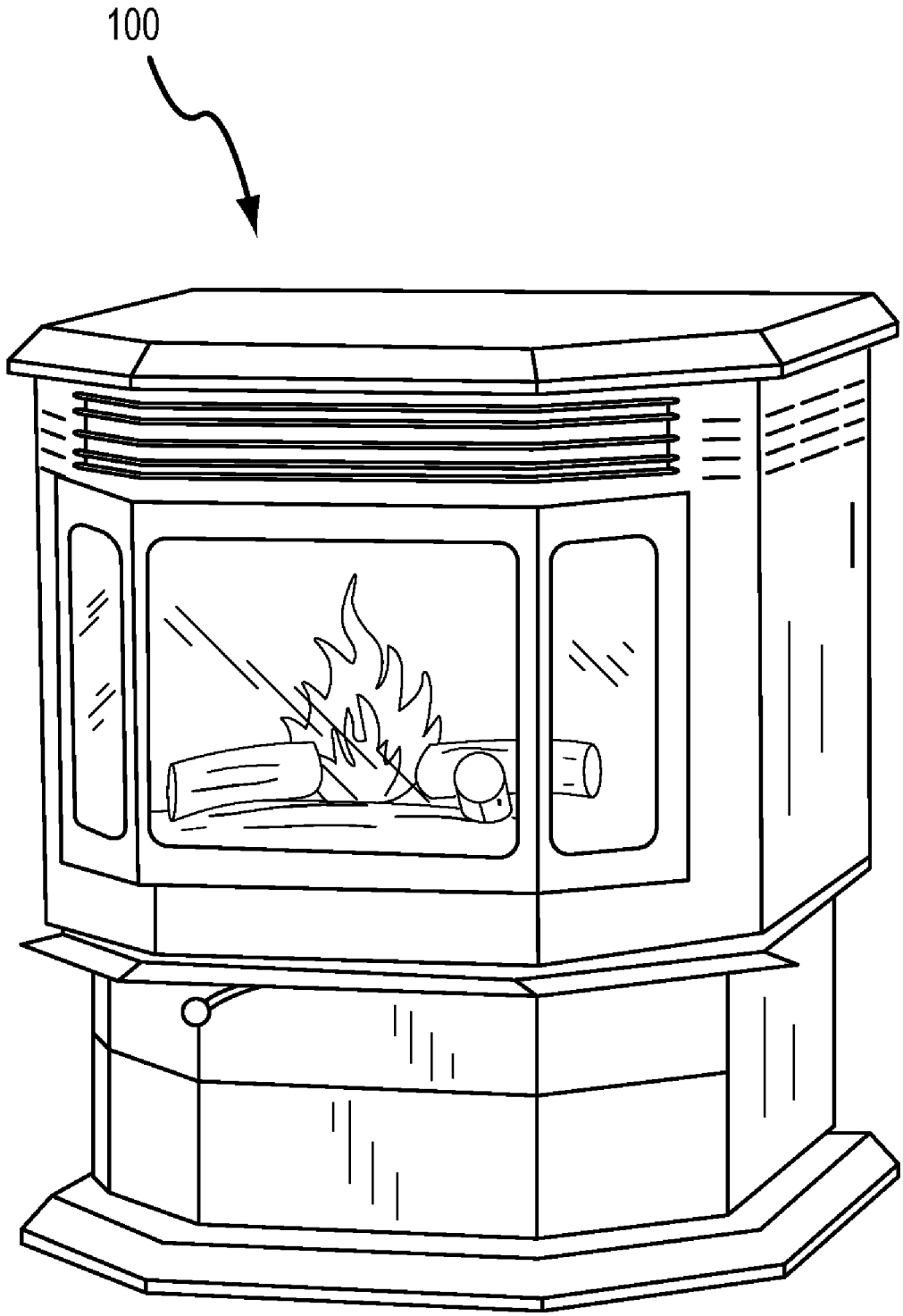
FIG. 1 illustrates a front perspective view of an exemplary pellet stove, according to embodiments of the present invention.

An exemplary pellet stove 100 is illustrated in FIG. 1. Embodiments of pellet stoves in accordance with the present invention provide greater power efficiency than conventional pellet stoves, enable a user to set a wider range of parameters than in the past, and provide automated features for stove cleaning, ignition, temperature control, and blower control, based on parameters such as, for example, fuel type. Embodiments of pellet stoves described herein are able to burn a wider variety of types of biomass solid fuels, including without limitation: corn, wood pellets, cherry pits, nut shells, sunflower seeds, and pea pellets. Advantageously, pellet stoves according to embodiments of the present invention can automatically adapt various functions based on the type of fuel, and other user preset parameters. In addition, assembly of pellet stoves and/or components of pellet stoves is made easier by unique component attributes, such as a single piece fuel hopper, a rail-based cleaning assembly, and a combustion blower with a round output pipe to facilitate ease of pipe connection, according to embodiments of the present invention.

Pellet stoves, pellet stove control systems, and pellet stove components in accordance with embodiments of the present invention are described herein. The particular embodiments that are illustrated and described are intended to enable one of skill in the art to make and use preferred embodiments, and are not intended to limit the scope of the invention in any way. Indeed, the described stoves, control systems, and components can be used in different applications than those described herein. The following description of illustrative embodiments is divided into several parts: firebox, blower motors, auto-cleaning system, hopper, stove control systems, user interface, and operations.

As used herein, the term "coupled" is used in its broadest sense to refer to elements which are connected, attached, and/or engaged, either directly or integrally or indirectly via other elements, and either permanently, temporarily, or removably. The term "communicably coupled" is used herein in its broadest sense to mean any coupling whereby information may be passed. Thus, for example, communicably coupled includes electrically coupled by, for example, a wire; optically coupled by, for example, an optical cable; and/or wirelessly coupled by, for example, a radio frequency or other transmission media.

Exemplary Firebox

An exemplary embodiment of a firebox enhances airflow and heat exchange to enable, among other advantages, more efficient heat generation than that found in conventional systems. In this embodiment, the back wall of the firebox, which also merges into the top of the firebox, forms a barrier between air and other gases inside the firebox and air flowing up the outside of the firebox to provide convection heating. The back wall and/or top wall of the firebox has numerous protrusions projecting outward from the inner (front) and rear (back) surfaces. The protrusions are preferably airfoils, and are arranged in a substantially symmetrical arrangement on the surfaces of the back wall. Tests have shown that airfoils projecting from surfaces of the firebox can provide for optimal heat exchange and low airflow noise (low Reynolds number).

Figure 2:
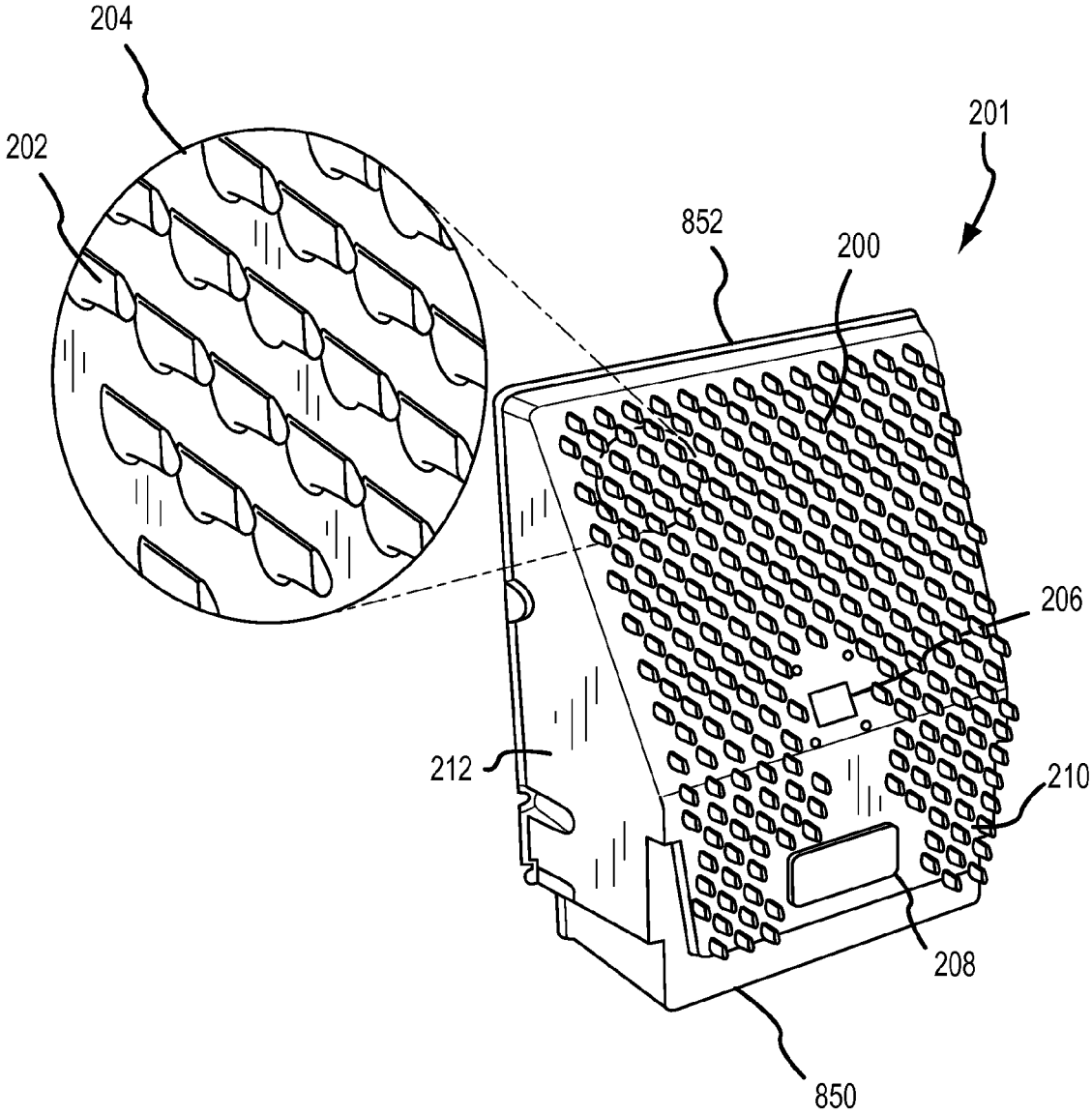
FIG. 2 illustrates a back perspective view of a firebox with a detailed view of airfoils, according to embodiments of the present invention.
Figure 3:
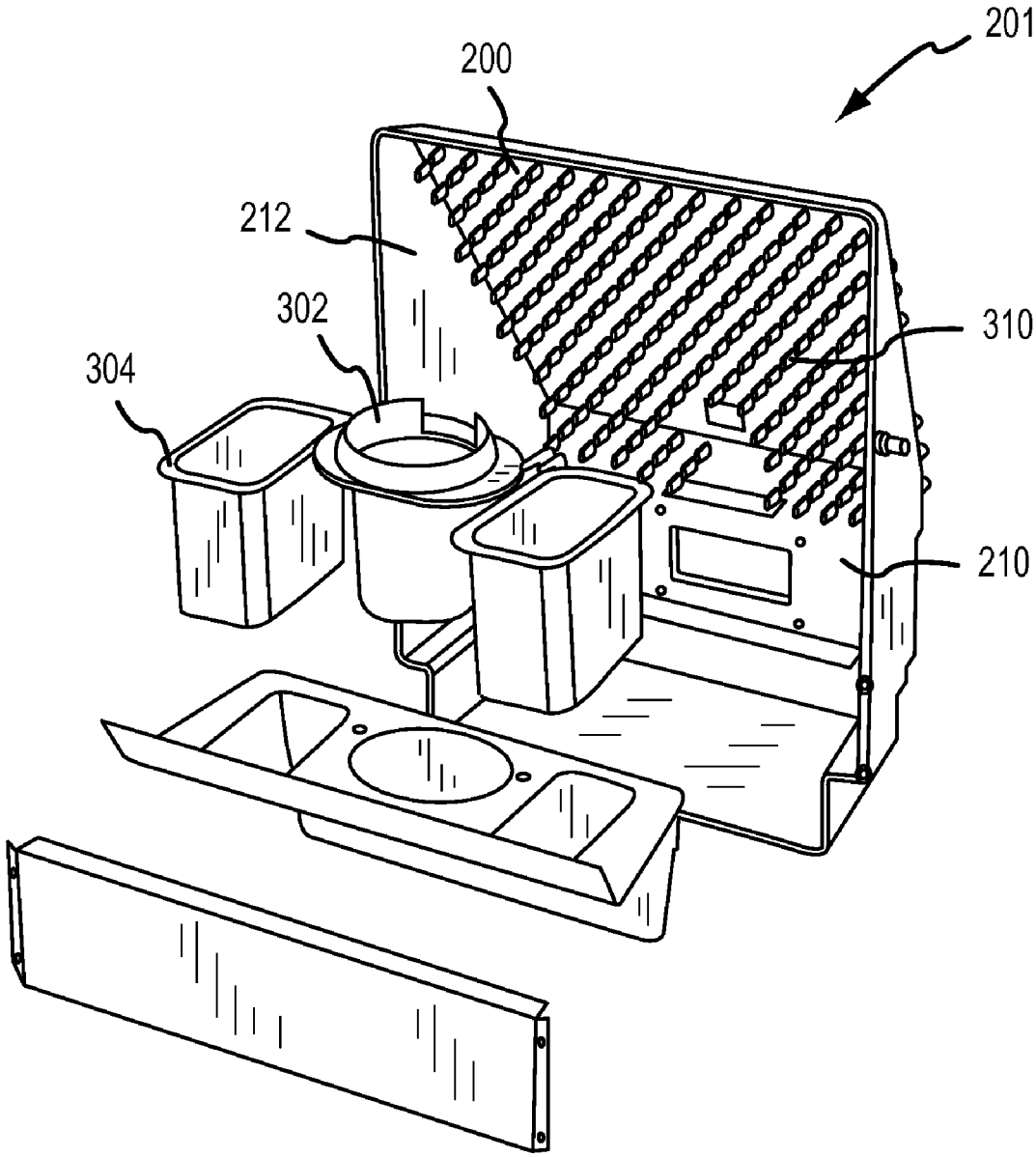
FIG. 3 illustrates an exploded front perspective view of a firebox, firepot, and ash pot components of a pellet stove according to embodiments of the present invention.

FIG. 2 is a perspective rear view of a firebox enclosure 201, including a top wall 200, side walls 212, and back wall 210 in accordance with various embodiments. In one embodiment, the enclosure 201, the top wall 200 and/or the back wall 210 are made of cast iron. Multiple laminar airfoils 202 are arranged in diagonal rows about the outer surfaces of the top wall 200 and back wall 210. Detail window 204 provides a magnified view of the airfoils 202. A perspective view of the inner surface 310 of the firebox enclosure 201 is shown in FIG. 3. The front, or inner, surface 310 of the top wall 200 and/or back wall 210 also includes multiple airfoils 202 arranged similarly to the airfoils 202 on the rear surface of the back wall 200. According to some embodiments of the present invention, there are an equal number of airfoils on the inner surface of the top wall 200 and on the outer surface of the top wall 200. In the illustrated embodiment, the laminar airfoils 202, the top wall 200, the back wall 210 and the side walls 212 are of the same unibody construction, meaning that the airfoils 202 are an integral part of the combustion enclosure 201. According to embodiments of the present invention, such unibody construction results in enhanced thermal characteristics for enclosure 201.

Figure 4:
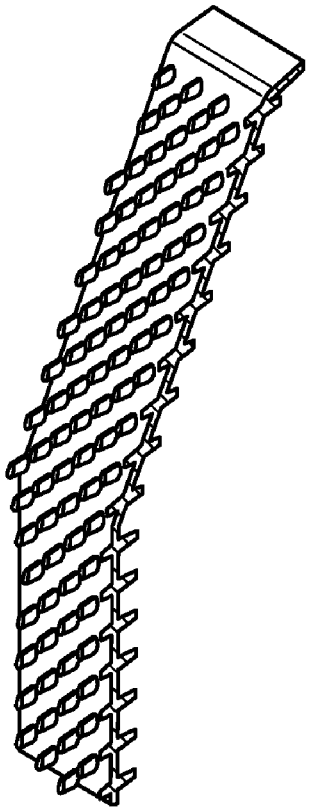
FIG. 4 illustrates a partial front perspective view of an alternative pin heat exchanger pattern according to embodiments of the present invention.
Figure 5:
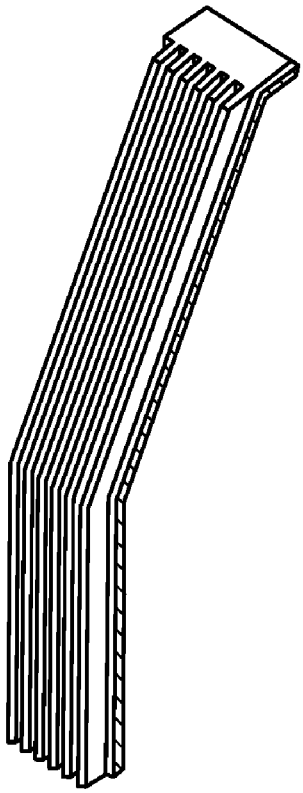
FIG. 5 illustrates a partial front perspective view of an alternative fin heat exchanger pattern according to embodiments of the present invention.

According to alternative embodiments of the present invention, the inner and/or outer surfaces of top wall 200 and/or back wall 210 may instead include a pin heat exchanger pattern as depicted in FIG. 4, or a fin heat exchanger pattern as depicted in FIG. 5, instead of the airfoil heat exchanger pattern depicted in FIGS. 2 and 3. According to yet other embodiments of the present invention, the combustion enclosure 201 includes a combination of two or more of the pin heat exchanger pattern, the fin heat exchanger pattern, and the airfoil heat exchanger pattern.

Figure 6:
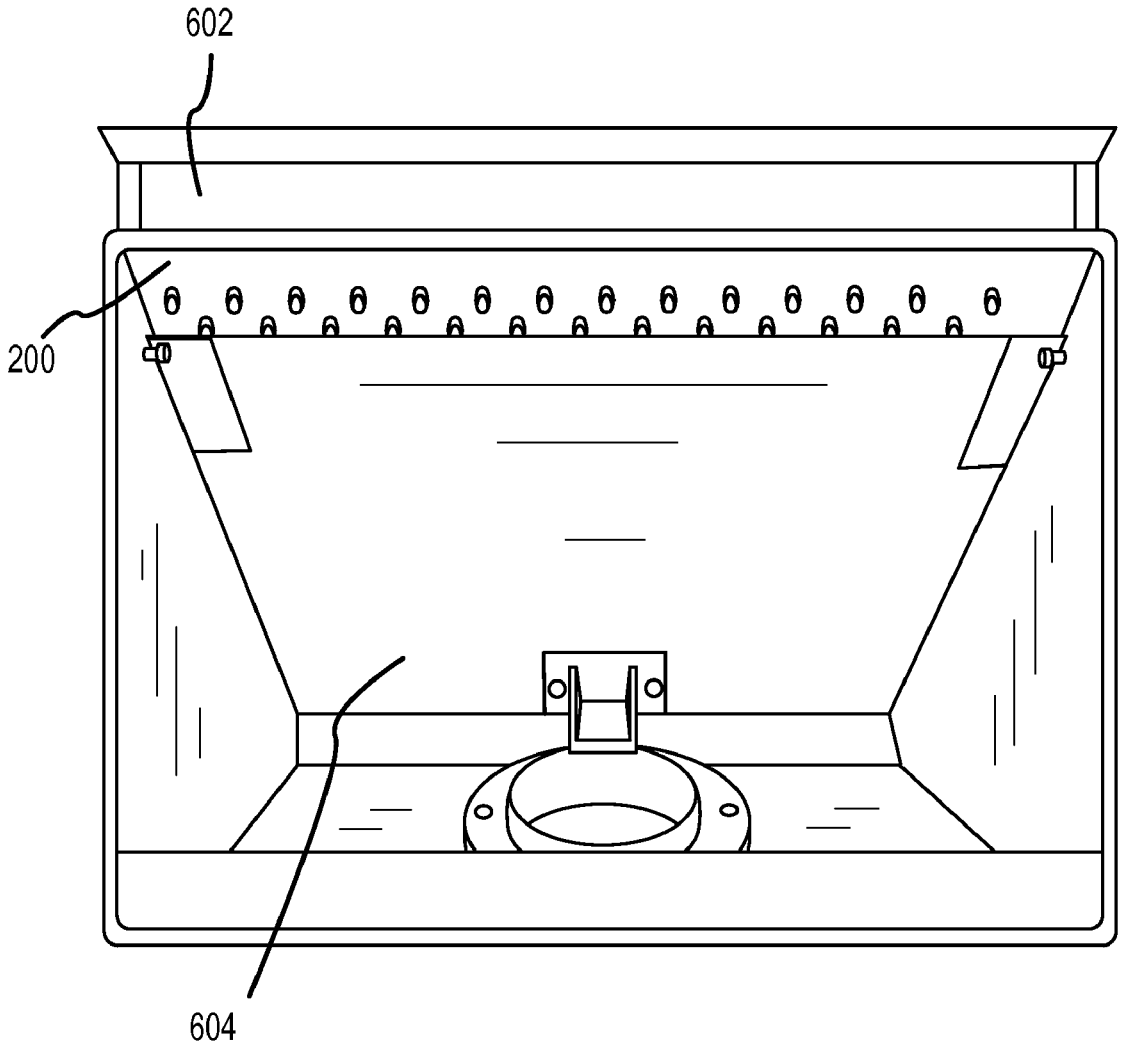
FIG. 6 illustrates a front view of a combustion enclosure, according to embodiments of the present invention.
Figure 7:
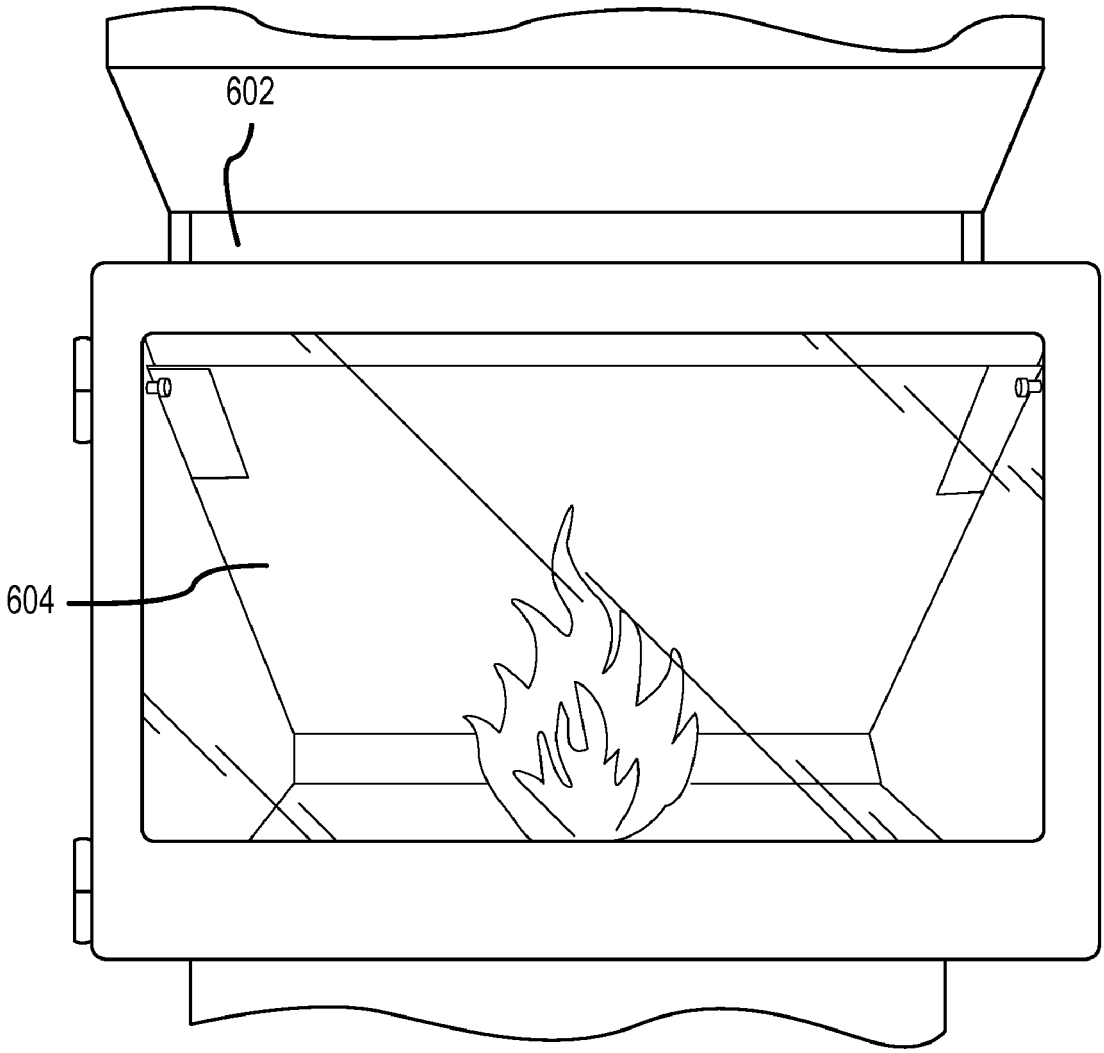
FIG. 7 illustrates a front view of a pellet stove and combustion enclosure during combustion, according to embodiments of the present invention.

In the embodiments of FIGS. 2 and 3, fuel pellets enter the firebox through a pellet aperture 206 in the back wall 200. The fuel pellets are burned in a firepot 302, creating ash that deposits in one or more ash canisters 304. Firepot 302 is discussed in further detail below. Exhaust from the burning exits the firebox through an exhaust aperture 208. A convection blower blows air along the outside of the back wall through a convection air chamber 602, to create a counter-flow heat exchanger. FIG. 6 illustrates an inside view of enclosure 201, and FIG. 7 illustrates an inside view of the enclosure 201 during combustion, according to embodiments of the present invention. The airfoils 202 increase surface area exposed to the air to maximize heat transfer in the convection process.

According to some embodiments of the present invention, a plate 604 may be placed on the inside of the combustion enclosure 201. Plate 604 may be spaced apart from or touching the tips of the airfoils 202 on the inner surface of the top wall 200, according to embodiments of the present invention. When plate 604 is in place, the exhaust gas from the combustion enters behind the plate 604 near the top of plate 604 and flows between plate 604 and inner surface 310 of top wall 200 before exiting through exhaust aperture 208, thereby increasing the surface area of inner surface 310 over which the hot exhaust gas passes. In this way, convection heat transfer occurs from the hot exhaust gases to the airfoils 202 on the inside of the combustion enclosure 201. The heat is then conducted through the top wall 200 and/or back wall 210 to the airfoils 202 on the other, outer side of the combustion enclosure 201, over which is blown a separate stream of air. Another plate and/or manifold may be placed over the outer surface of combustion enclosure 201 to contain the airflow generated by the combustion blower. This airflow over the outer surface of the enclosure 201 is heated via convection by contact with the airfoils 202, which increase the surface area of the enclosure 201 in contact with the air. As such, the enclosure 201 acts as a heat exchanger, taking heat from the hot exhaust gases and adding it to a convective heating airflow.

Figure 8B:
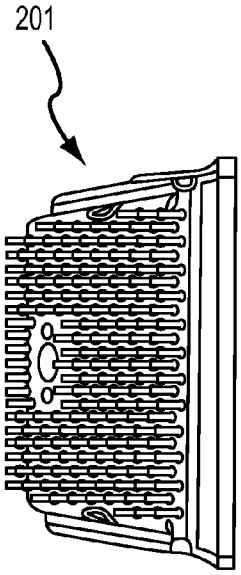
FIG. 8B illustrates a top view.
Figure 8A:
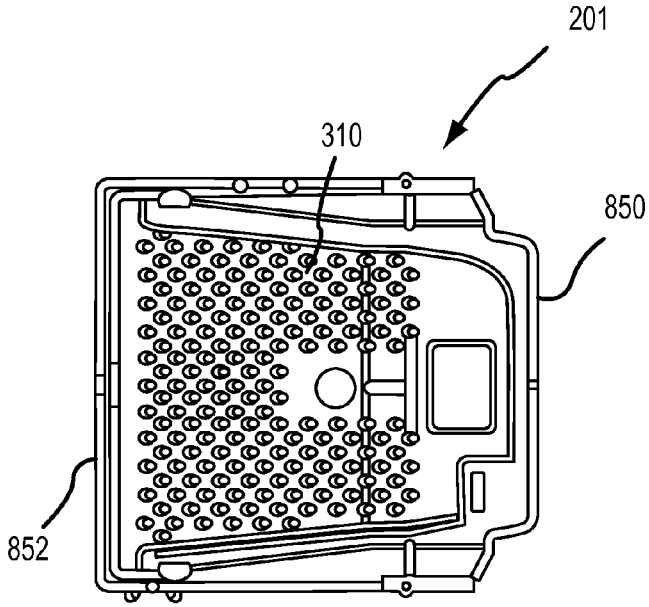
FIG. 8A illustrates a front view of a combustion enclosure according to embodiments of the present invention.
Figure 8C:
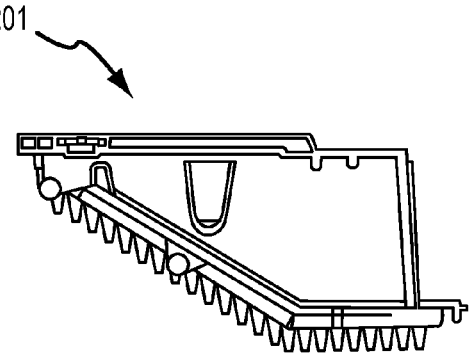
FIG. 8C illustrates a side view.
Figure 8D:
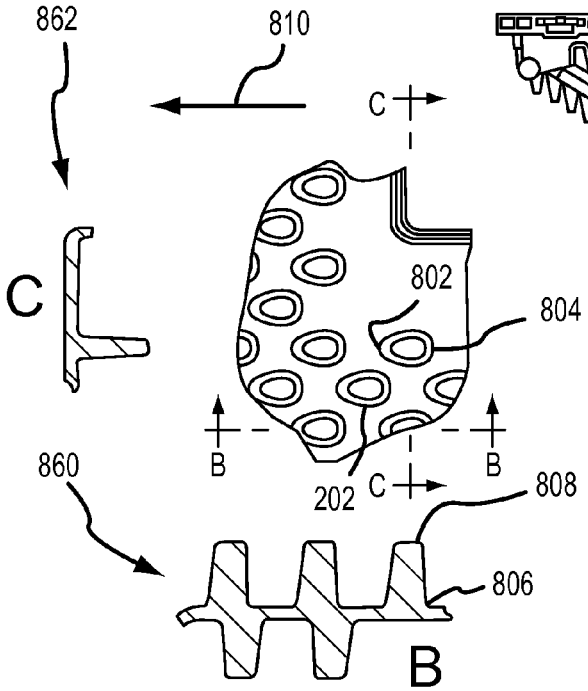
FIG. 8D illustrates a detailed view and two partial cross sectional views of airfoils on a combustion enclosure, according to embodiments of the present invention.
Figure 8E:
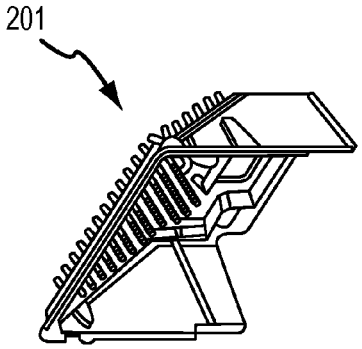
FIG. 8E illustrates a back perspective view of the combustion enclosure of FIG. 8A, according to embodiments of the present invention.

According to such embodiments of the present invention, the fluid (e.g. air) flow across the outside or outer surface of the enclosure 201 is in an opposite direction from the fluid flow across the inner surface of the enclosure 201. The airfoils 202 as depicted in detail in FIG. 8D each include a leading edge 804 and a trailing edge 802 which is narrower than the leading edge 804, and a tip 808 which is narrower than the base 806. Airfoils 202 are oriented such that the fluid (e.g. air) flows over them from leading edge 804 to trailing edge, as defined by fluid flow arrow 810 of FIG. 8D which indicates the direction of fluid flow with respect to the airfoils 202. Thus, because the heated exhaust flows from top 852 to bottom 850 along the inner surface 310 of enclosure 210 as depicted in FIG. 8A, the airfoils 202 in FIG. 8A are formed in an opposite orientation from the airfoils 202 along the outer surface of the enclosure 201 in FIG. 2 along which the convection blower blows air from bottom 850 to top 852. FIG. 8A also includes a partial cross sectional view 860 taken along line B-B of FIG. 8A and a partial cross sectional view taken along line C-C of FIG. 8A. FIG. 8B shows a top view, FIG. 8C shows a left side view, and FIG. 8E shows a back perspective view of the enclosure 201, according to embodiments of the present invention. Air blown by the convection blower over the outer surface of the top wall 200 and back wall 210 exits toward the top of enclosure 201 through opening 602, as illustrated in FIGS. 6 and 7, according to embodiments of the present invention. The shape of airfoils 202 leads to a smoother, steadier laminar flow across the airfoils 202, which in turn contributes to decreasing noise generated by blowing air across the airfoils 202, to improving convection heat transfer, and in some cases to decreasing the work of the convection blower in blowing the air across the airfoils 202.

Exemplary Blowers

Figure 9:
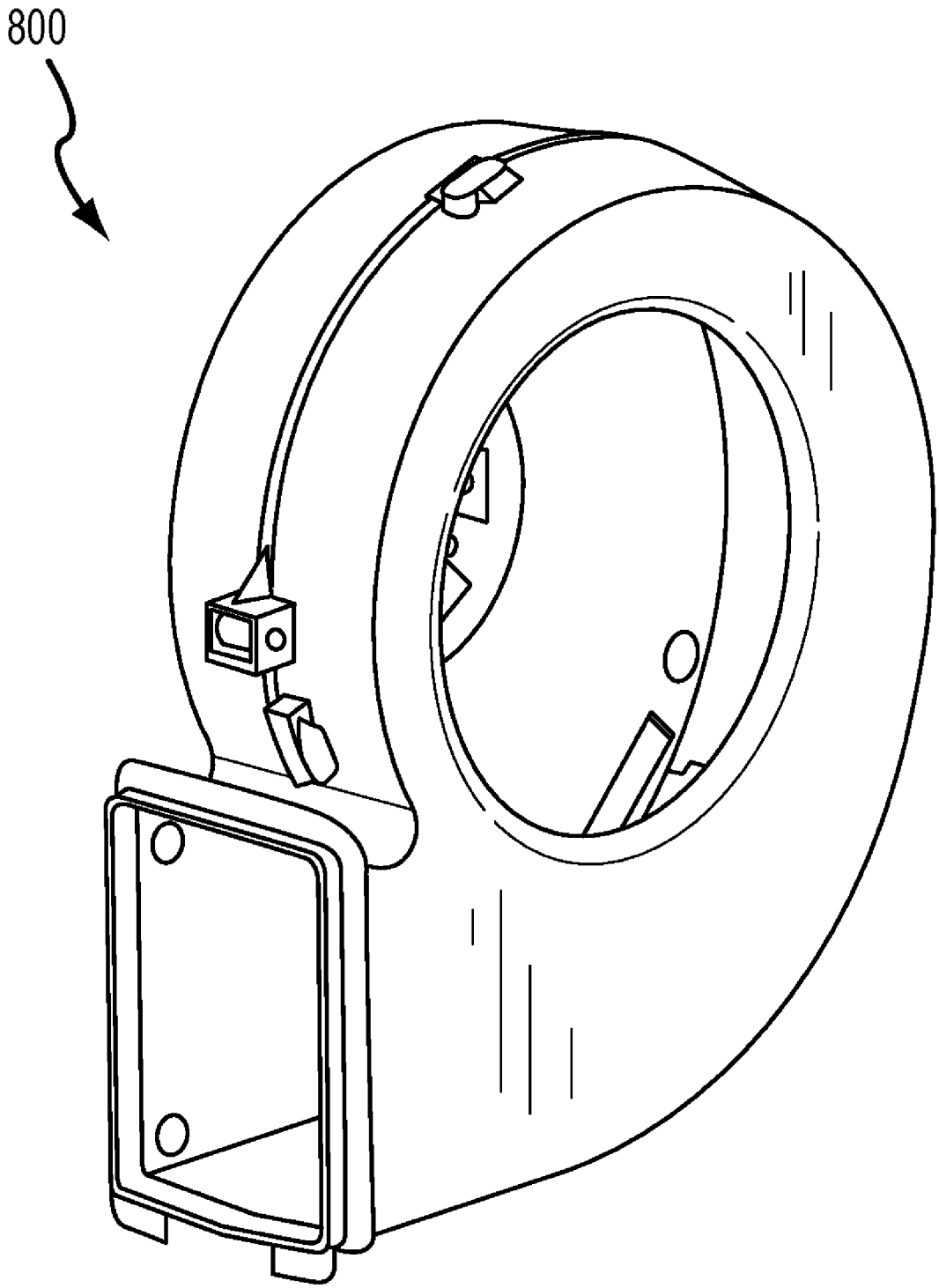
FIG. 9 illustrates a convection blower, according to embodiments of the present invention.
Figure 10:
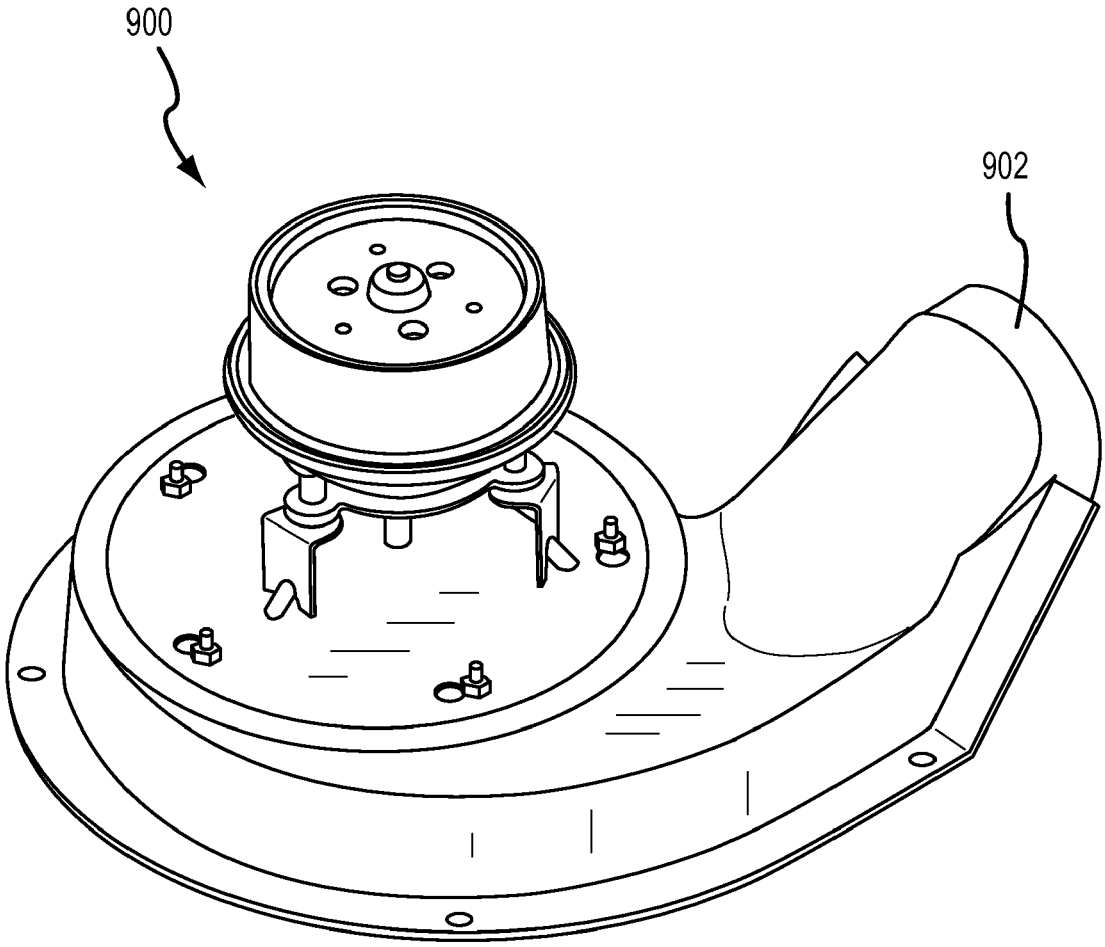
FIG. 10 illustrates a combustion blower, according to embodiments of the present invention.
Figure 11:
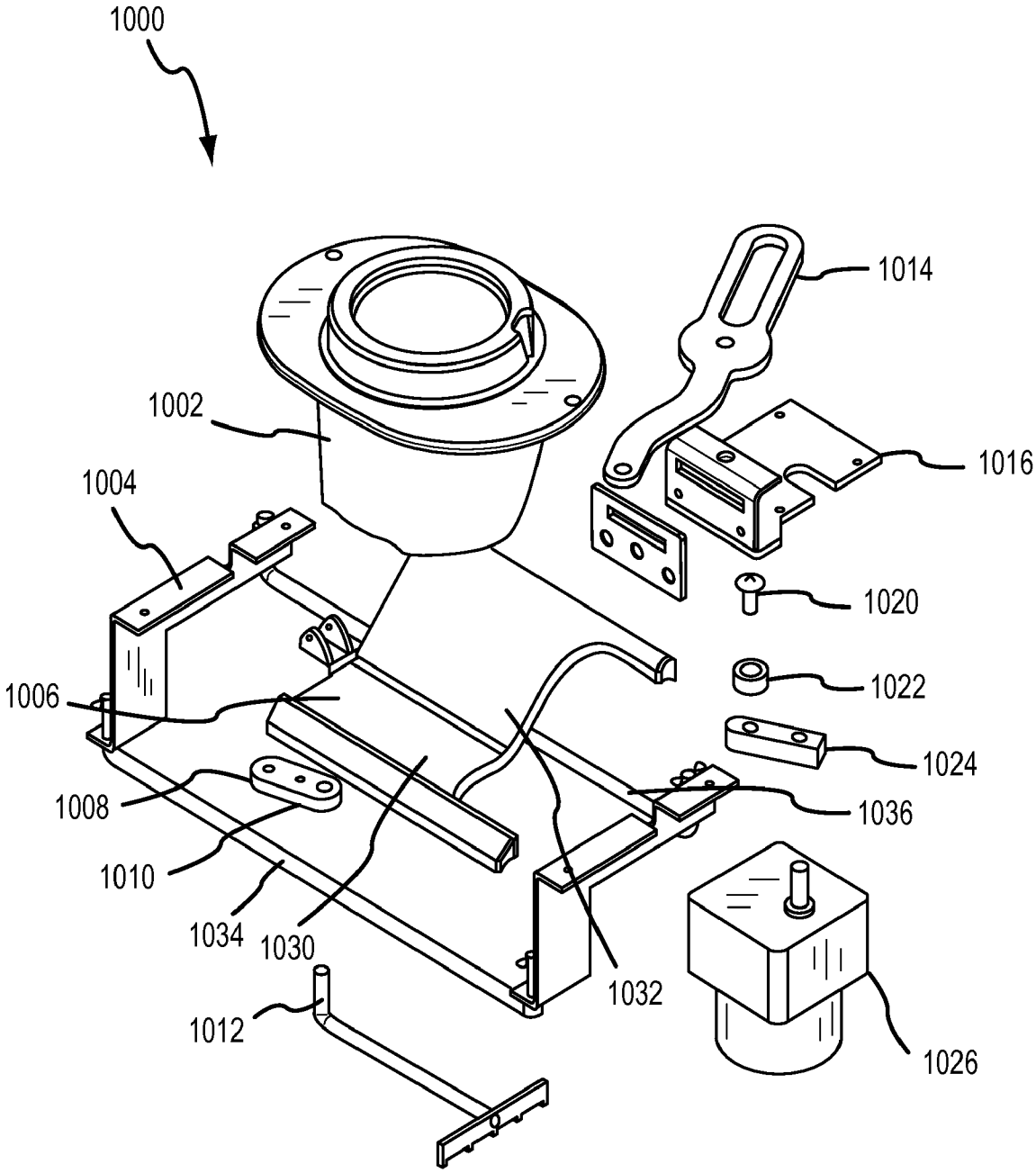
FIG. 11 illustrates an exploded front perspective view of a firepot assembly, according to embodiments of the present invention.
Figure 12:
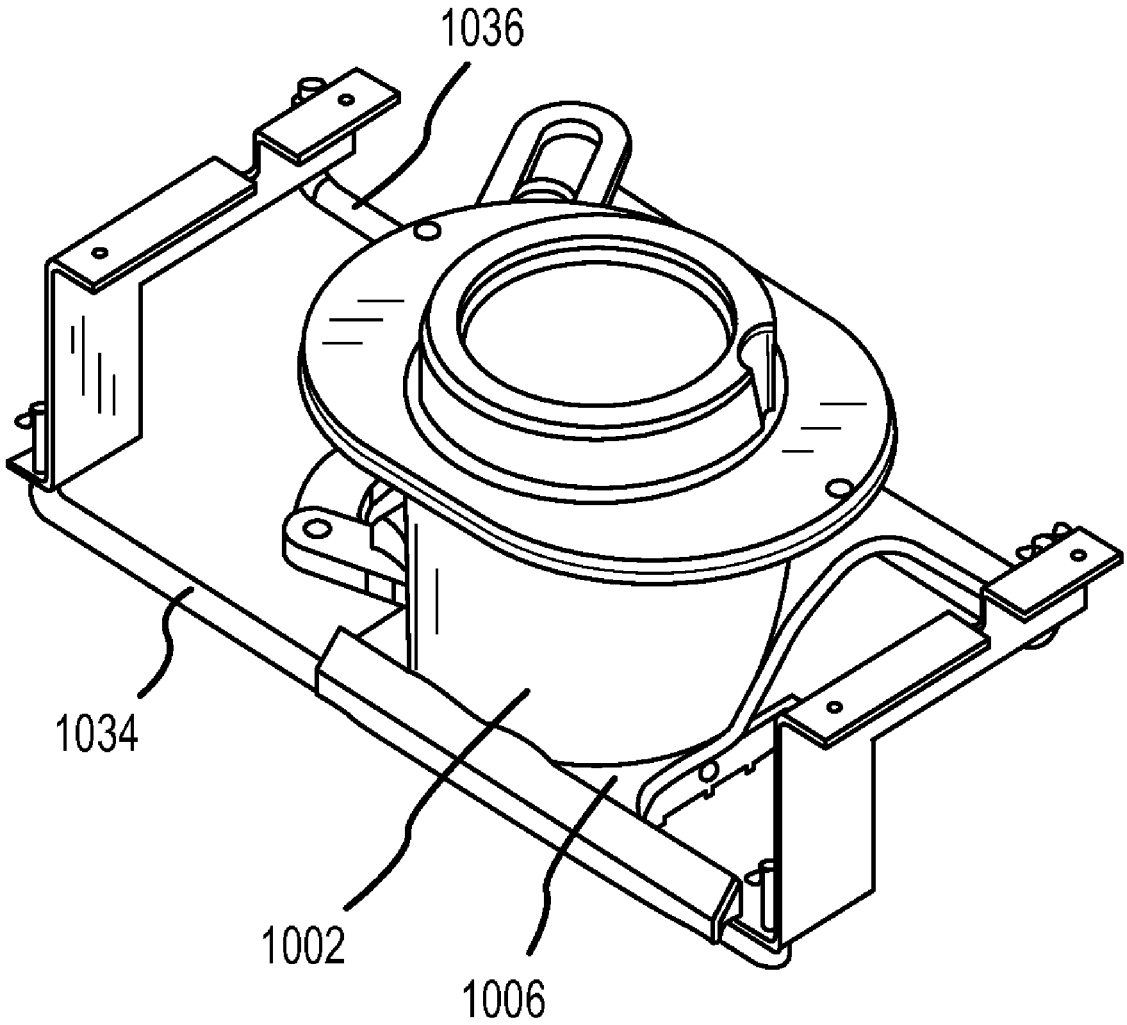
FIG. 12 illustrates a front perspective view of the firepot assembly of FIG. 11, according to embodiments of the present invention.
Figure 16:
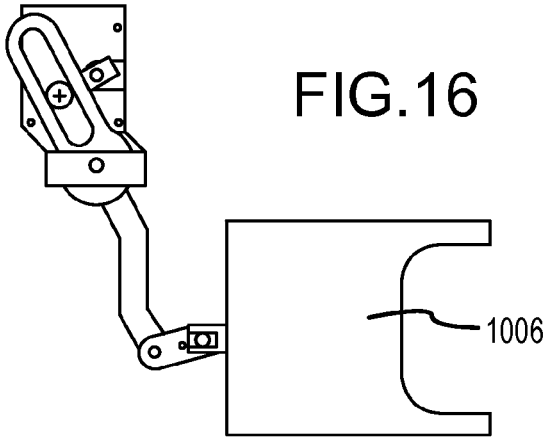
FIG. 16 illustrates a top view of a firepot bottom plate actuation assembly according to embodiments of the present invention.
Figure 13:
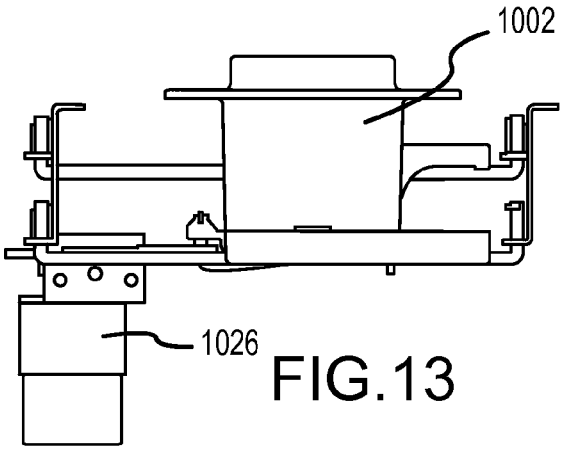
FIG. 13 illustrates a front view of a firepot assembly, according to embodiments of the present invention.
Figure 14:
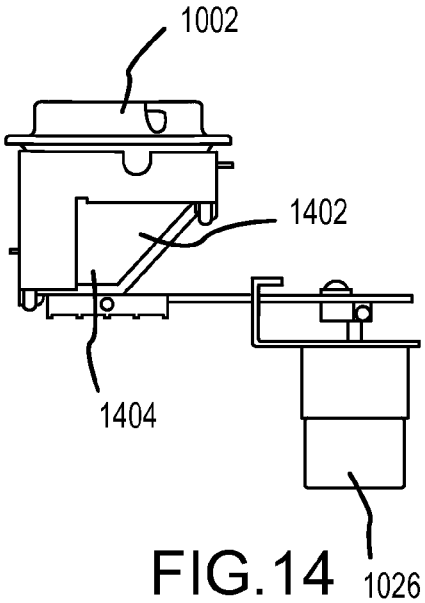
FIG. 14 illustrates a side view of the firepot assembly of FIG. 13, according to embodiments of the present invention.
Figure 15:
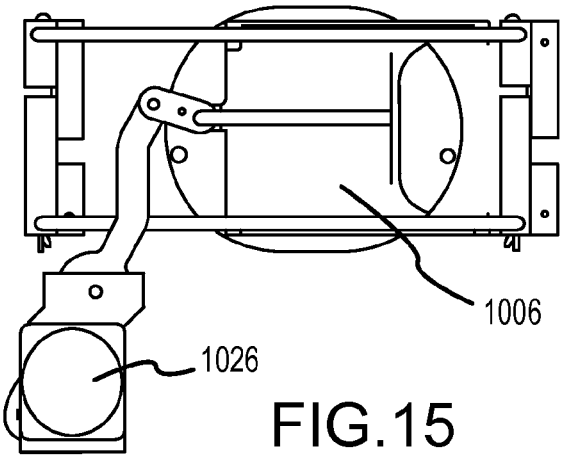
FIG. 15 illustrates a bottom view of the firepot assembly of FIGS. 13-14, according to embodiments of the present invention.

Two blowers are used in accordance with embodiments of the present invention: a convection blower and a combustion blower. An exemplary convection blower 800 is shown in FIG. 9 and an exemplary combustion blower 900 is shown in FIG. 10. The blowers 800, 900 are preferably multiple speed blowers (e.g., 3 fan speeds).

The convection blower 800 may be a three phase DC motor with a Hall effect sensor, according to embodiments of the present invention. This particular convection blower has an external rotor. Thus, the heaviest part of the motor spins with the impeller. As such, the blower effectively handles dust, cat hair, and other debris. The convection blower 800 includes an embedded circuit board that allows for communication with a stove control system (discussed further below). The convection blower 800 provides feedback to the control system, which enables the control system to adjust the speed of the motor. In one embodiment, the blower 800 communicates current draw and rotation speed (e.g. RPM) to the control unit.

In accordance with various embodiments, rotation speed (e.g. RPM) of the blower 800 is steadily maintained by maintaining a steady voltage level. Line power coming into the home or building is converted to twelve volts direct current. As a result, fluctuations in the line voltage do not impact the rotational speed (e.g. RPM) of the blower motor. The blower 800 has eight wires connected to it to provide power and communication, according to embodiments of the present invention.

The combustion blower 900 may also be a three phase DC motor with a Hall effects sensor, according to embodiments of the present invention. Like the convection blower 800, the combustion blower 900 includes a twelve volt direct current motor with an external rotor. The combustion blower 900 is also in communication with the stove control system for providing feedback of current draw and rotational speed, so that the stove control system can adjust the rotational speed of the combustion blower 900 based on preset parameters (discussed further below). Advantageously, the combustion blower 900 has a round outlet 902 that facilitates ease of pipe fitting during installation by the installer and/or manufacturer, according to embodiments of the present invention.

In some embodiments, hot air from the pellet stove is pumped to various locations in the building or house that is being heated. In these embodiments, another fan (called a distributor fan) may be included that blows heated air into ducts (e.g., heating, and/or air-conditioning ducts) that distribute the heated air to one or more other spaces. The distributor fan can also be activated and deactivated by the stove control unit. In these embodiments, the pellet stove and ducts comprise a central heating system.

In accordance with various embodiments, the pellet stove includes a Peltier module that uses heat to generate and store an electrical charge. The Peltier module can be used to run fans and other powered portions of the stove, such as, for example, the stove control unit. The Peltier module can also charge a battery that can be used to start the stove.

Auto-Cleaning System

An embodiment of an automatic cleaning system (auto-cleaning system) 1000 is illustrated in FIG. 10-20. A firepot 1002 is seated in the floor at a position where it receives pellet fuel falling from the hopper. The pellet fuel burns in the firepot 1002, and as a result, ash can build up in the firepot 1002. The base 1404 of the firepot 1002 is cutout and a portion of the back side 1402 (see FIG. 14) of the firepot 1002 is cutout. Beneficially, the auto-cleaning system 1000 includes a slideable firepot floor 1006 (also referred to as a bottom plate 1006) that can be opened and closed such that ash in the firepot 1002 drops out from the base 1404 and back side 1402.

The bottom plate 1006 of the firepot 1002 is a single piece consisting of a horizontal portion 1030 abutting the base of the firepot 1002 and a ramped portion 1032 abutting the back side of the firepot 1002, according to embodiments of the present invention. A plow arm 1012 is connected to the underside of the firepot floor 1006 and to one end 1010 of a linkage. The other end 1008 of the linkage is coupled with pivotable lever arm 1014. The lever arm 1014 is pivotably mounted to a pivot bracket 1016. A channel at the distal end of the lever arm 1014 holds a cam roller 1022 (attached, e.g., by screw 1020 to driver arm 1024) that mechanically links the lever arm 1014 to a gear motor 1026 that drives the cam roller 1022 in the channel of the lever arm 1014.

Figure 19:
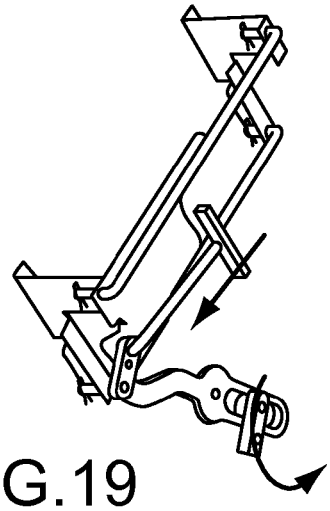
FIG. 19 illustrates the firepot bottom plate actuation assembly of FIGS. 17 and 18 during a cleaning cycle, according to embodiments of the present invention.
Figure 22:
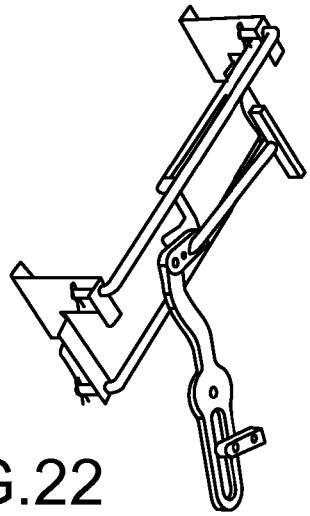
FIG. 22 illustrates the firepot bottom plate actuation assembly of FIGS. 17-21 at the end of a cleaning cycle, according to embodiments of the present invention.
Figure 18:
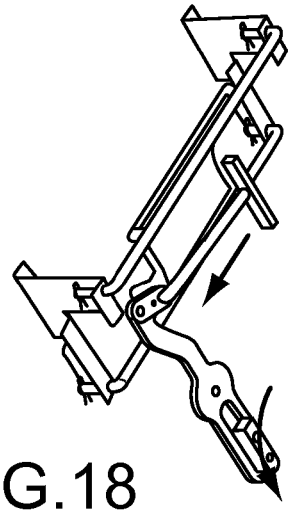
FIG. 18 illustrates the firepot bottom plate actuation assembly of FIG. 17 during a cleaning cycle, according to embodiments of the present invention.
Figure 21:
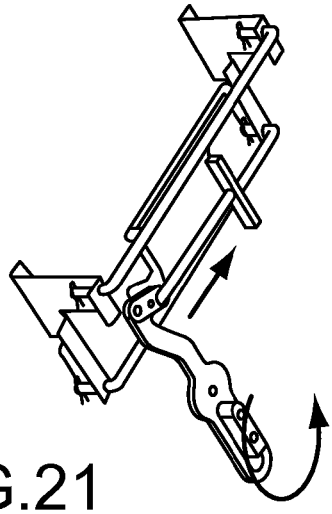
FIG. 21 illustrates the firepot bottom plate actuation assembly of FIGS. 17-20 during a cleaning cycle, according to embodiments of the present invention.
Figure 17:
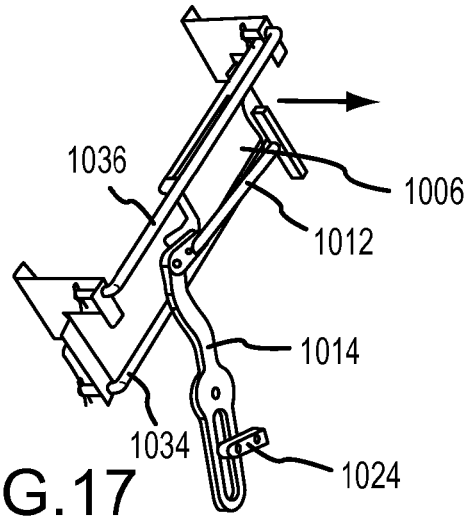
FIG. 17 illustrates a firepot bottom plate actuation assembly at the beginning of a cleaning cycle, according to embodiments of the present invention.
Figure 20:
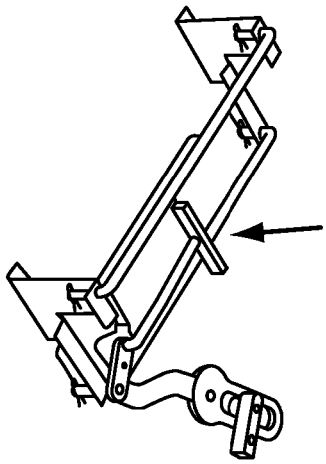
FIG. 20 illustrates the firepot bottom plate actuation assembly of FIGS. 17-19 during a cleaning cycle, according to embodiments of the present invention.
Figure 26:
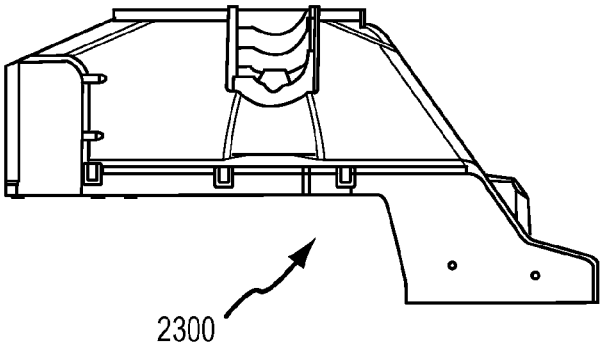
FIG. 26 illustrates a front view of the one-piece hopper of FIGS. 23-25, according to embodiments of the present invention.
Figure 23:
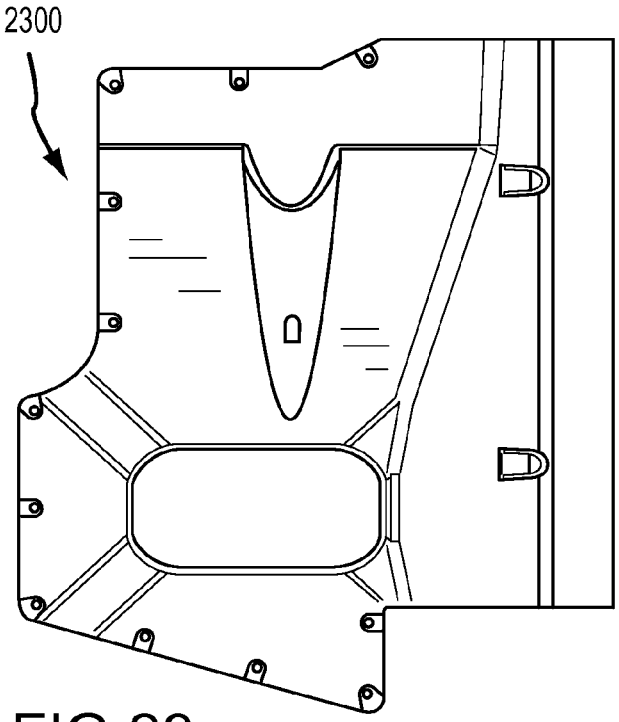
FIG. 23 illustrates a top view of a one-piece hopper, according to embodiments of the present invention.
Figure 24:
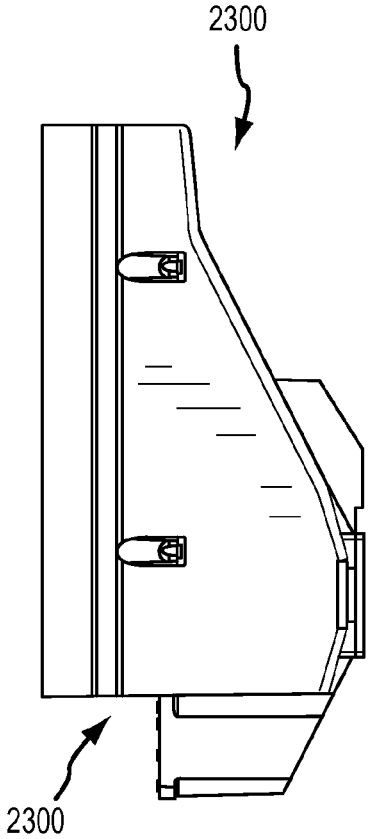
FIG. 24 illustrates a side view of the one-piece hopper of FIG. 23, according to embodiments of the present invention.
Figure 25:
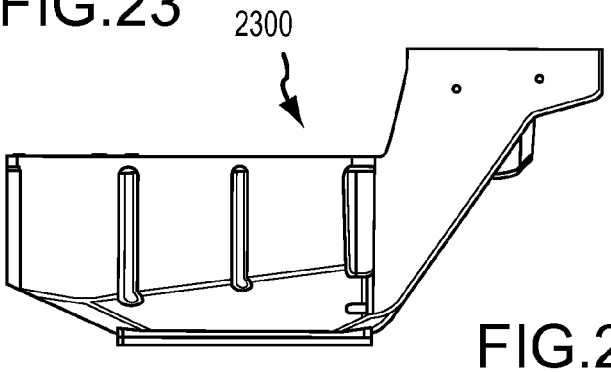
FIG. 25 illustrates a back view of the one-piece hopper of FIGS. 23 and 24, according to embodiments of the present invention.
Figure 30:
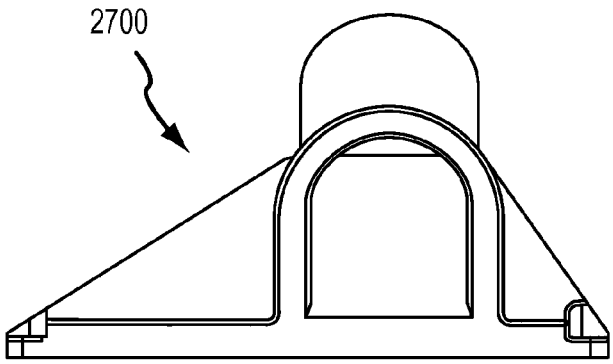
FIG. 30 illustrates a front view of the hopper chute of FIGS. 27-29, according to embodiments of the present invention.
Figure 27:
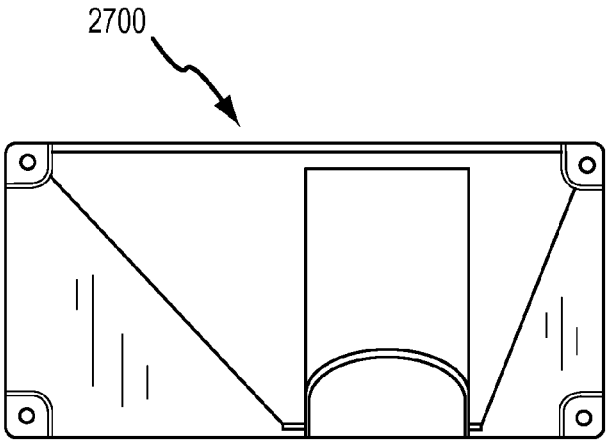
FIG. 27 illustrates a top view of a hopper chute, according to embodiments of the present invention.
Figure 28:
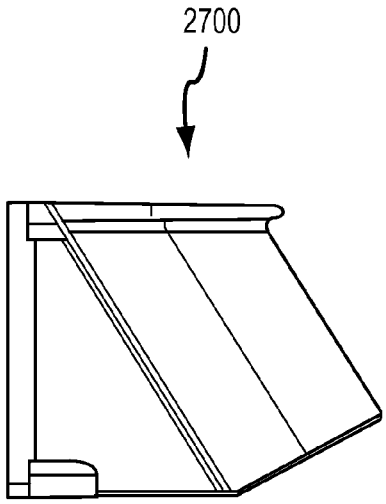
FIG. 28 illustrates a side view of the hopper chute of FIG. 27, according to embodiments of the present invention.
Figure 29:
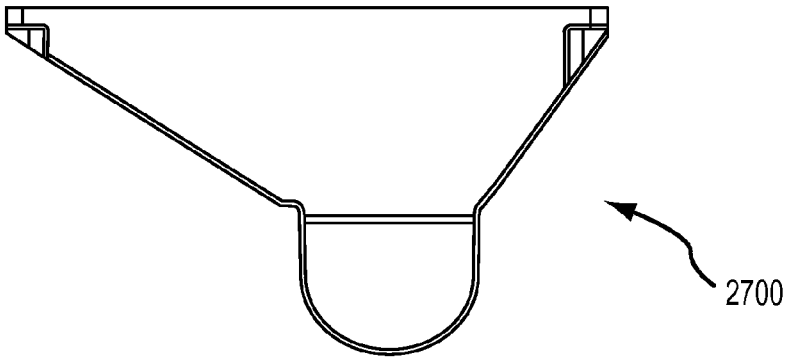
FIG. 29 illustrates a back view of the hopper chute of FIGS. 27 and 28, according to embodiments of the present invention.
Figure 34:
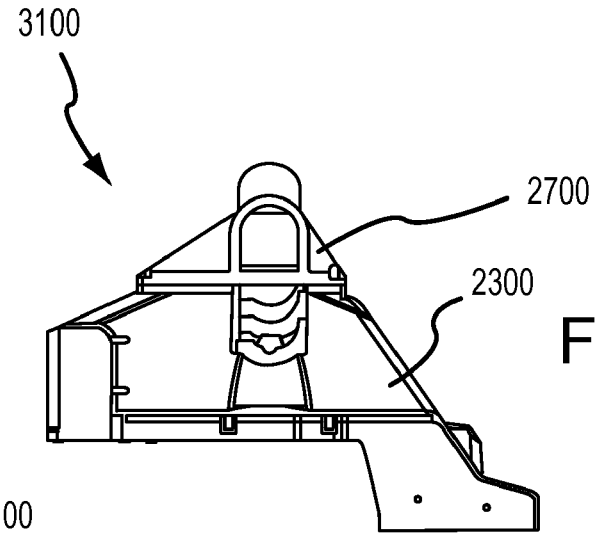
FIG. 34 illustrates a front view of the hopper assembly of FIGS. 31-33, according to embodiments of the present invention.

The firepot floor 1006 has front and back runners that rest on rails of a rail assembly 1004. Rail assembly includes a front rail 1034 and a rear or back rail 1036. When the gear motor 1026 is turned on, it drives a shaft that causes the cam roller 1022 to roll in the channel of the lever arm 1014, which in turn causes the lever arm 1014 to pivot about the pivot point. When the lever arm 1014 pivots, it pulls the plow arm 1012 in a lateral motion, which, in turn opens the firepot floor 1006. According to some embodiments of the present invention, when power is removed from the gear motor 1026, the firepot floor 1006 returns to the closed position. According to other embodiments of the present invention, motor 1026 is a stepper motor and a full rotation of the drive shaft corresponds to a full open-and-close cycle of the auto cleaning system. FIGS. 17-22 illustrate sequential views of the actuation of the bottom plate 1006 by the motor 1026, beginning with FIG. 17 when the bottom plate 1006 starts underneath the firepot 1002. FIG. 18 shows the slotted lever arm 1014 beginning to pull the bottom plate 1006 back, and FIG. 19 illustrates the bottom plate 1006 pulled into the "open" position for the firepot 1002, in which the opening (e.g. 1402 and 1404) is unobstructed and the ash is free to exit the firepot 1002. FIGS. 20 and 21 illustrates the lever arm 1014 beginning to push the bottom plate 1006 back under the firepot 1002, and FIG. 22 illustrates the bottom plate 1006 back in a "closed" position where the bottom plate 1006 substantially prevents the fuel, spent or unspent, from exiting the firepot 1002, according to embodiments of the present invention.

Exemplary One-Piece Hopper

Figure 31:
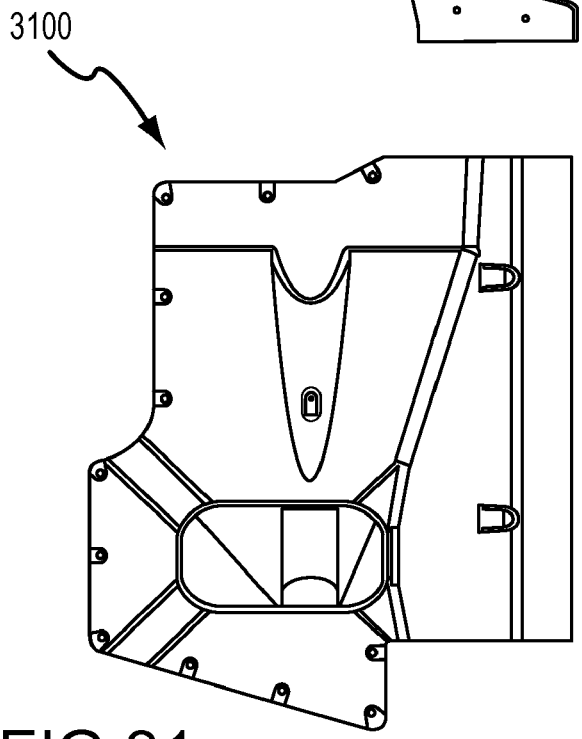
FIG. 31 illustrates a top view of a hopper assembly, according to embodiments of the present invention.
Figure 32:
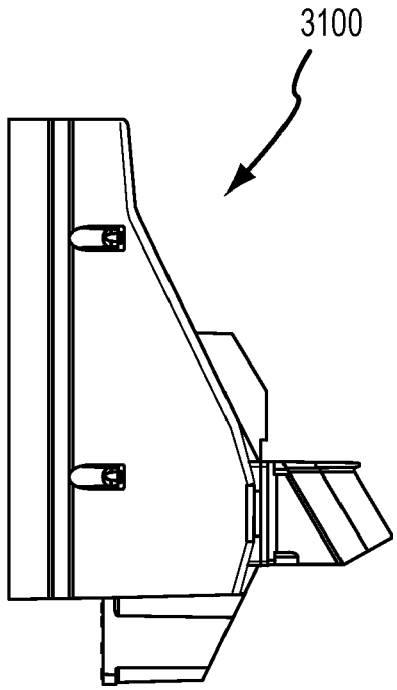
FIG. 32 illustrates a side view of the hopper assembly of FIG. 31, according to embodiments of the present invention.
Figure 33:
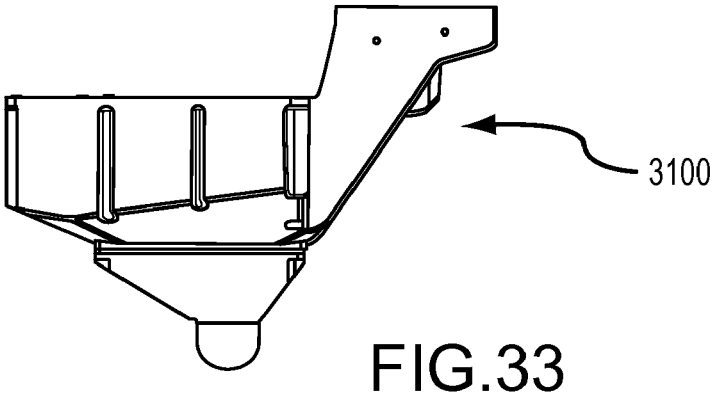
FIG. 33 illustrates a back view of the hopper assembly of FIGS. 31 and 32, according to embodiments of the present invention.

A pellet fuel hopper 1600 in accordance with one embodiment is illustrated in FIGS. 31-33 in various different views. In one embodiment, the volume of biomass that the hopper 1600 can hold ranges from fifty to eighty pounds, but the invention is not so limited. Virtually any types of fuel pellets can be put into the hopper 1600. In accordance with various embodiments, sunflower seeds, cherry pits, peanut shells, pea pellets, as well as more conventional types of fuel like wood pellets and corn, can be put into the hopper 1600.

FIGS. 23-26 depict a one-piece hopper 2300, and FIGS. 27-30 depict a hopper chute 2700, according to embodiments of the present invention. FIGS. 31-34 depict a hopper assembly 3100, including the hopper 2300 and the chute 2700, according to embodiments of the present invention. Unlike conventional hoppers, the hopper 2300 of FIGS. 31-33 is a one-piece hopper. Among other advantages, the one-piece configuration makes assembly of the pellet stove easier than conventional systems. When the pellet stove is assembled, the hopper assembly 3100 is connected to the firebox via a connection that guides the feed into the fire box, where it is burned. More specifically, the feed tube chute 2700 in the base of the hopper assembly 3100 provides a channel through which fuel drops from the hopper 2300 and into the fuel pellet aperture 206 of the firebox. In some embodiments, and depending on the positioning of the hopper assembly 3100 relative to the firebox, the chute 2700 may be a more or less elongated chute with a distal end into which fuel enters from the hopper 2300, and a proximate end attached to the pellet aperture 206, and from which fuel pellets exit the chute 2700.

The feed tube chute 2700 may include an auger capable of stopping or starting the feeding of fuel. Accordingly, when the auger of the feed tube chute 2700 is actuated, fuel pellets drop from the hopper 2300, travel down the chute 2700 and are dispensed into the firebox enclosure 201. In accordance with various embodiments, the auger of the chute 2700 is actuated by a feed motor (not shown) that is controlled by a stove control system (discussed further below). As such, the feed motor of the hopper assembly 3100 is in communication with the stove control systems and receives commands that are generated based on operational settings.

Exemplary Pellet Stove Control System

Embodiments of the present invention include a pellet stove control system. In general, the stove control system provides functionality for performing various processes automatically. By way of example, but not limitation, the control system may automatically clean the firepot, automatically ignite the fuel, or automatically add more fuel pellets to the firebox. Various embodiments of the stove control system include a stove control unit and a wall control unit. Certain parameters are set by the user through a user interface of the wall control unit. Such parameters may include, but are not limited to, a preferred temperature, fuel type, day and time, fuel feed rate, language, and manual or automatic mode.

In accordance with a particular embodiment, the stove control unit is located at, or is part of, the pellet stove, while the wall control unit is located a distance away on the wall. The wall control unit is communicably coupled with the stove control unit. Such communication may be implemented wirelessly or wired, or any combination thereof. In general, the stove control unit receives commands from the wall control unit, and carries out processes in response to the commands. For example, the wall control unit may send the preferred temperature and fuel type to the stove control unit, and the stove control unit may automatically cause fuel to be fed into the firebox at a designated rate, and/or cause the automatic cleaner to clean the firepot at designated times. According to other embodiments of the present invention, various aspects of the stove control unit may be physically located at or near or performed by the wall control unit; various aspects of the wall control unit may be physically located at or near or performed by the stove control unit, and/or a combination of various aspects of the stove control unit and wall control unit may be physically located at or near or performed by both the stove control unit and the wall control unit.

Figure 35:
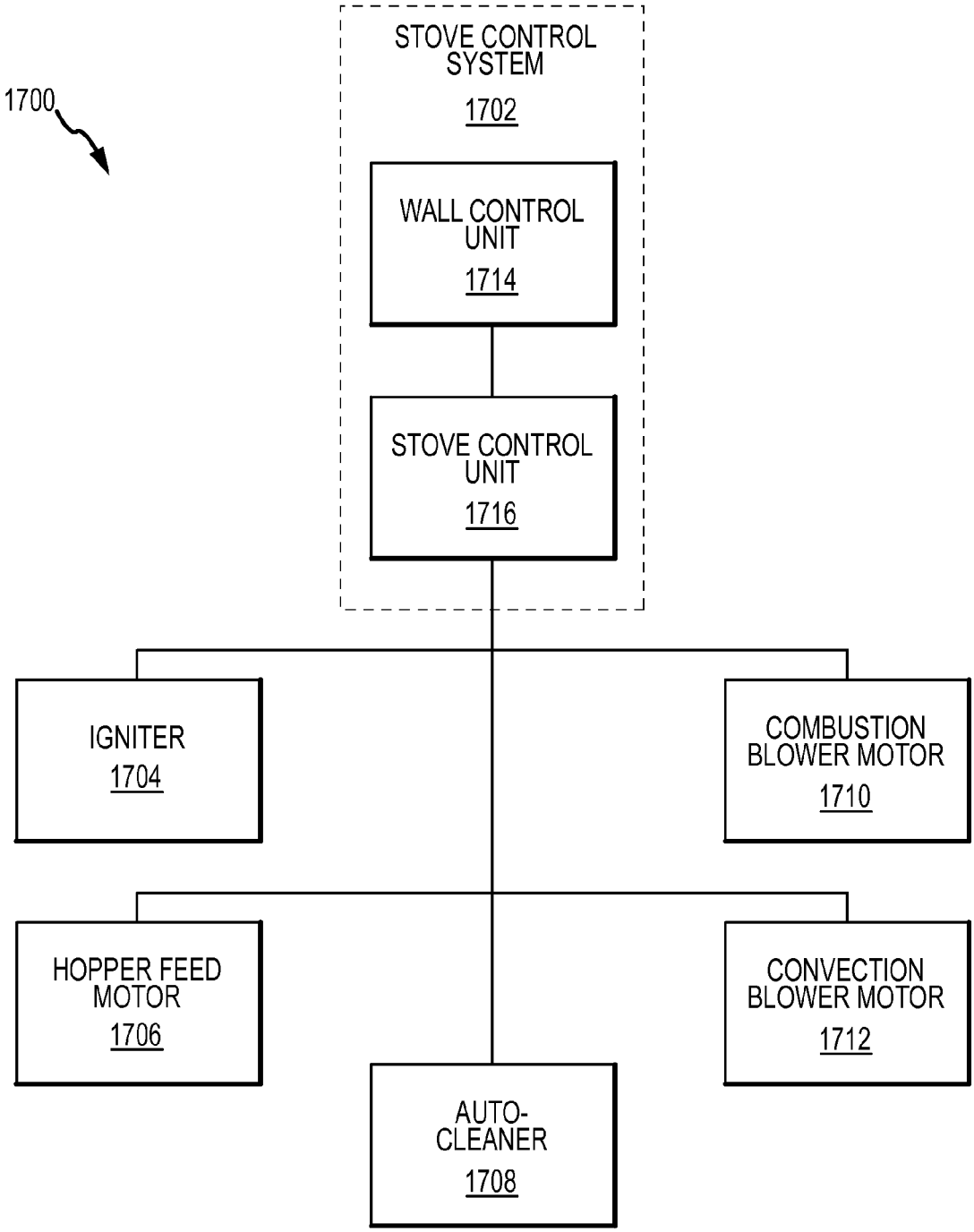
FIG. 35 illustrates an exemplary pellet stove control system, according to embodiments of the present invention.

FIG. 35 is a functional block diagram of an operating environment 1700 including a stove control system 1702, a pellet stove igniter 1704, a hopper feed motor 1706, an auto-cleaner system 1708, a combustion blower motor 1710, and a convection blower motor 1712. The stove control system 1702 includes two subunits: a wall control unit 1714 and a stove control unit 1716. In operation, the user enters parameters into the wall unit 1714. One or more of the parameters are communicated to the stove control unit 1716. The stove control unit 1716 then controls the igniter 1704, hopper feed motor 1706, auto-cleaner 1708, combustion blower motor 1710, and convection blower 1712, based at least in part on the parameters from the wall control unit 1714. Exemplary processes carried out by the stove control system 1702 are described further below. Algorithms are illustrated in the form of flow charts, according to embodiments of the present invention.

Figure 36:
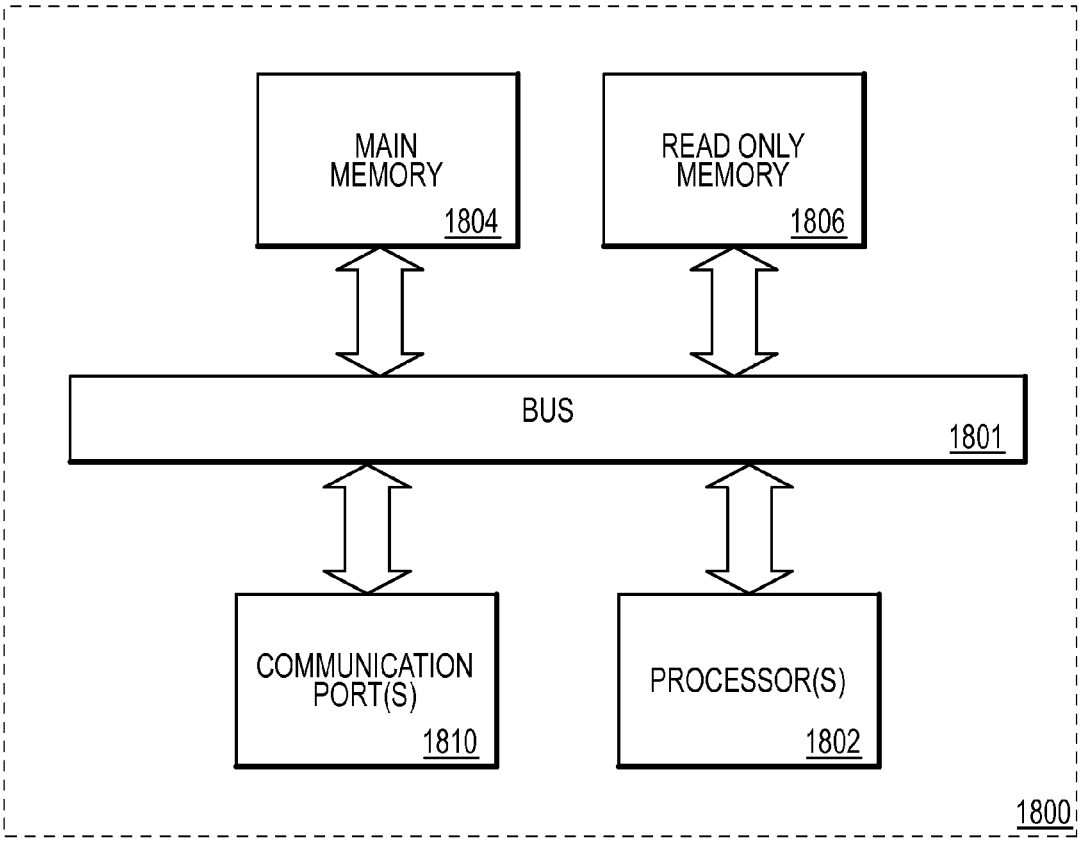
FIG. 36 illustrates an exemplary computing device, according to embodiments of the present invention.

FIG. 36 illustrates an exemplary machine in the form of a computing device 1800 which may be used to implement the wall control unit and/or the stove control unit. The functional components depicted in FIG. 36 are for illustrative purposes, and are intended to enable one skilled in the art to make and use a wall control unit and/or a stove control unit in accordance with one or more embodiments of the present invention. FIG. 36 is merely one example of a basic computing device, and is not intended to limit the number, types, arrangement, or interaction of components that may be used in a wall control unit and/or a stove control unit.

In this simplified example, the computing device 1800 comprises a bus or other communication means 1801 for communicating information, and a processing means such as one or more processors 1802 coupled with bus 1801 for processing information. Computing device 1800 further comprises a random access memory (RAM) or other dynamic storage device 1804 (referred to as main memory), coupled to bus 1801 for storing information and instructions to be executed by processor(s) 1802. Main memory 1804 also may be used for storing temporary variables or other intermediate information during execution of instructions by processor(s) 1802.

Computing device 1800 also comprises a read only memory (ROM) 1806 coupled to bus 1801 for storing static information and instructions for processor 1802. For example, in the case of the stove control unit, the ROM 1806 typically includes boot code for booting up the unit when it is powered on and one or more data tables that include data related to operation of various mechanisms of the pellet stove. Examples of data tables are shown and described in more detail below.

One or more communication ports 1810 may also be coupled to bus 1801 for allowing communication and exchange of information to/from with the computing device 1800. As discussed above, communication may be wired or wireless or a combination thereof. Communication ports 1810 typically enable communication between the wall control unit and the stove control unit, but may be part of a broader range of communication environments, such as, but not limited to a Local Area Network (LAN), Wide Area Network (WAN), Metropolitan Area Network (MAN), the Internet, or the public switched telephone network (PSTN). The communication ports 1810 may include various combinations of well-known interfaces, such as one or more modems to provide dial up capability, one or more 10/100 Ethernet ports, one or more Gigabit Ethernet ports (fiber and/or copper), or other well-known interfaces, such as Asynchronous Transfer Mode (ATM) ports and other interfaces commonly used in existing LAN, WAN, MAN network environments. In any event, in this manner, the computing device 1800 may be coupled to a number of other network devices.

In accordance with at least one embodiment, communication ports 1810 of the stove control unit interface with controllable components of the stove, such as an igniter, blower motors, automatic cleaning system motors, and fuel feeder mechanism. The control of these various stove components may vary depending on the type of fuel, the preferred temperature, or other preset parameters.

Parametric data is stored in memory of the stove control unit that can be used to control the components. The amount of memory in one embodiment of the stove controller ranges from 90 Kb to 128 Kb, but the invention is not so limited. Parametric data is configurable and updateable. Parametric data tables can be defined for each fuel type. Thus, for example, as new fuels are used, new data tables can be loaded into memory of the stove controller. Exemplary parameters that can be preset in memory and used in the control and management of automatic functions of the stove, include, but are not limited to, feed rate, auger speed, combustion fan speed, minimum temperature during burn, maximum temperature during burn, soft start low feed speed, soft start feed speed(s), soft start feed time(s), soft start blower speed(s), rise temperature during soft start, pot temperature after soft start, maximum number of ignition retries, auto clean pulse interval, start up feed charge speed, ignition time, snapshot time, snapshot temperature rise differential, cool down time, start up vacuum test combustion blower speed, start up ignition combustion blower speed, shutdown combustion blower speed, vacuum pressure threshold, drop tube maximum temperature, and power table data.

Exemplary User Interface

Figure 37:
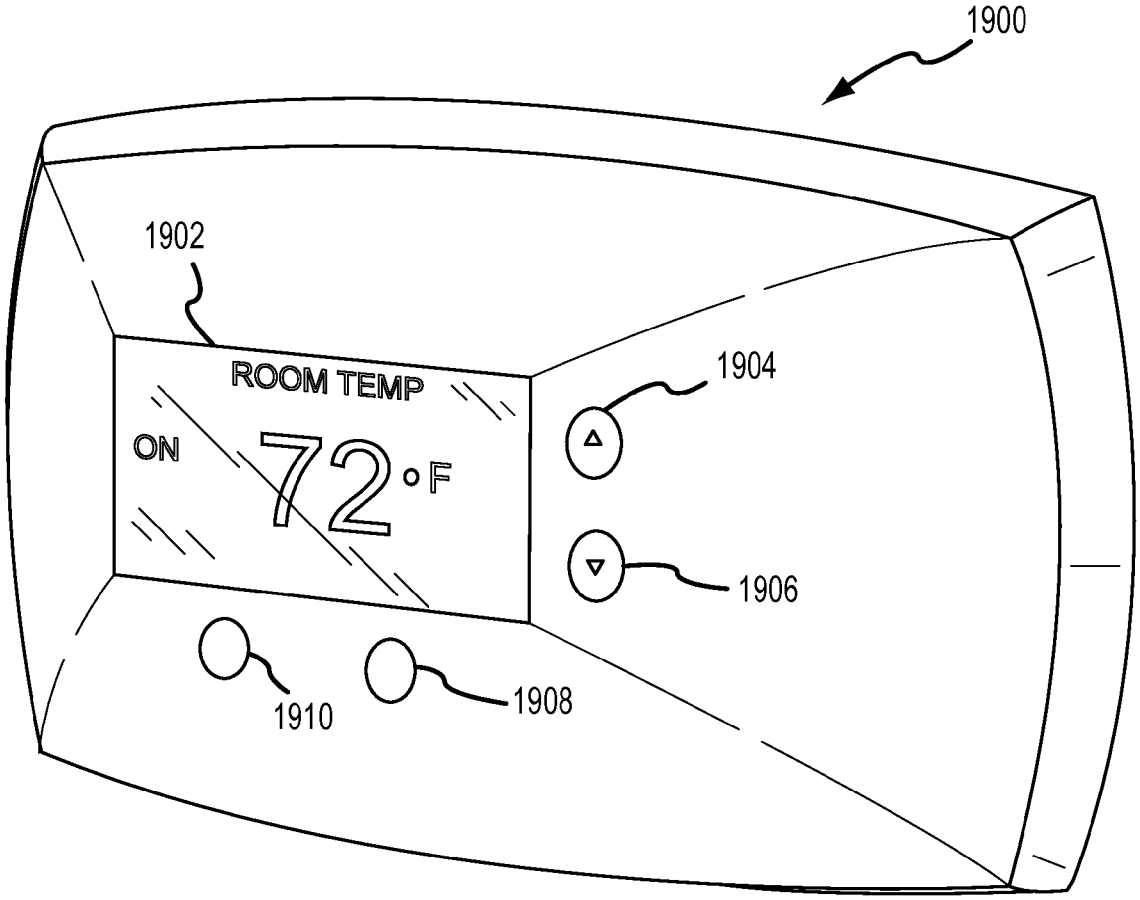
FIG. 37 illustrates a front perspective view of an exemplary wall control unit, according to embodiments of the present invention.

As described, the user of the pellet stove control system can enter parameters or settings related to operation of the pellet stove. In one embodiment, the wall control unit provides an interface through which the user enters the data. FIG. 37 illustrates one exemplary wall control unit 1900. The wall control unit 1900 has a display 1902. The display 1902 can be graphical or any other suitable type. The user sets parameters or changes settings using input mechanisms, such as press buttons 1904, 1906, 1908, and 1910. The invention is not limited to any particular type or number of input mechanisms.

For example, some embodiments include digital controls for at least part of the user interface. The digital controls can comprise hardware or software buttons or similar mechanisms that can be used to alter settings in discrete increments, in contrast with the infinitely variable analog controls such as dials. One advantage of digital controls on a display device (e.g., a monitor), for instance, is that a user can store settings in memory and restore them at a later time. Of course, these and other embodiments could include analog controls.

Figure 38:
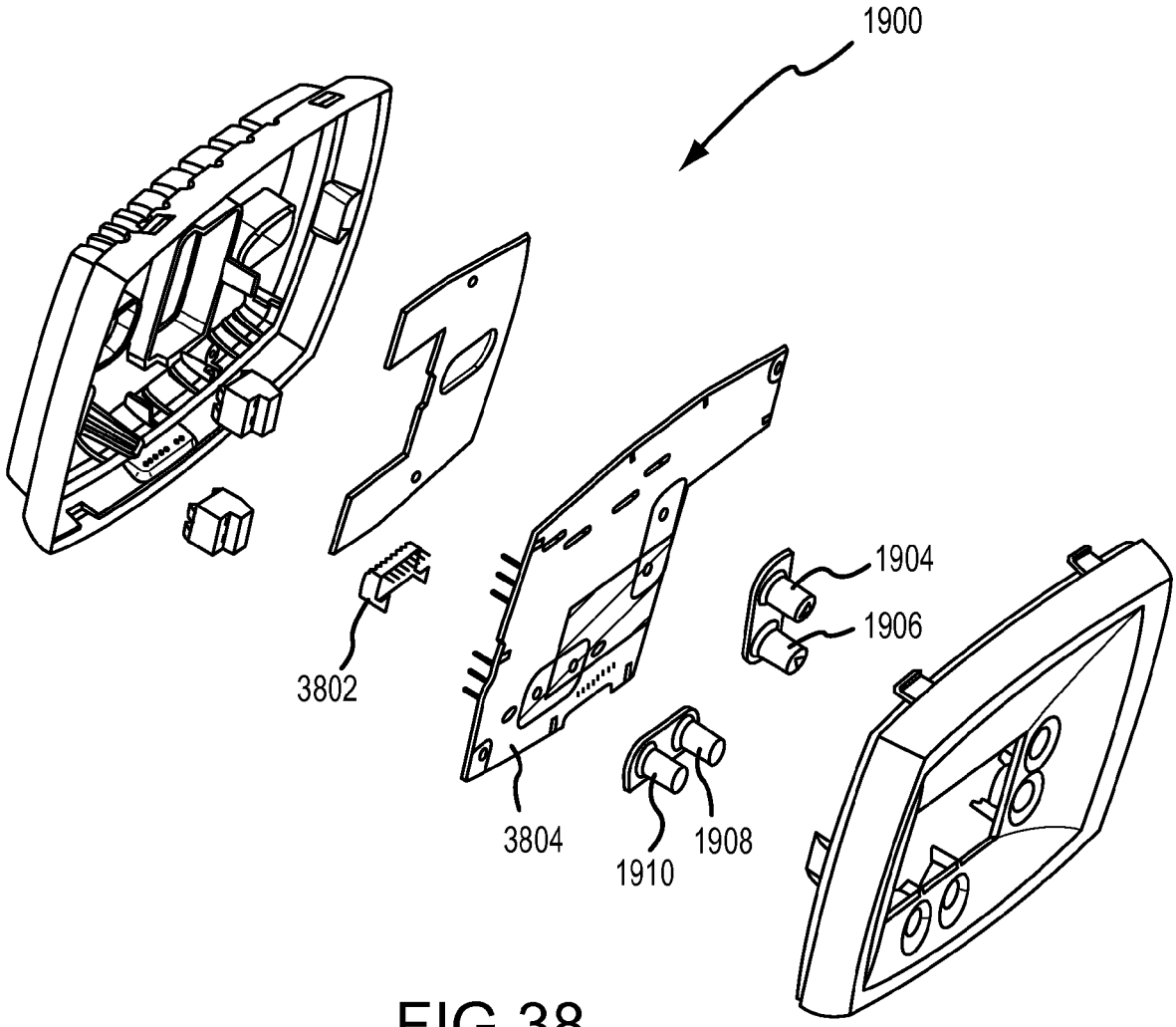
FIG. 38 illustrates an exploded front perspective view of an exemplary wall control unit, according to embodiments of the present invention.

FIG. 38 illustrates an exploded perspective view of wall control unit 1900. According to some embodiments of the present invention, wall control unit 1900 includes a communications interface 3802, such as, for example, a seven-pin or eight-pin connector, which communicably connects to a wall unit circuit board 3804. According to some embodiments of the present invention, a communications cable may be used to communicably connect to communications interface 3802 with a computer, a handheld device, or other electronic device to upload or download new operating code to or from the control board 3804, the wall control unit 1714 and/or the stove control unit 1716, to retrieve diagnostic information from or to initiate diagnostic operations for the wall control unit 1714 and/or the stove control unit 1716, and/or to add or modify information related to data stored on wall control unit 1714 and/or the stove control unit 1716, such as, for example, parametric data. According to some embodiments of the present invention, such a data interface may be wireless; in addition, the wall control unit 1714 may be communicably coupled with the stove control unit 1716 (e.g. wirelessly or by cable) to permit such data and programming operations to be made on stove control unit 1716 through the wall control unit 1714 interface, and vice versa.

Figure 39:
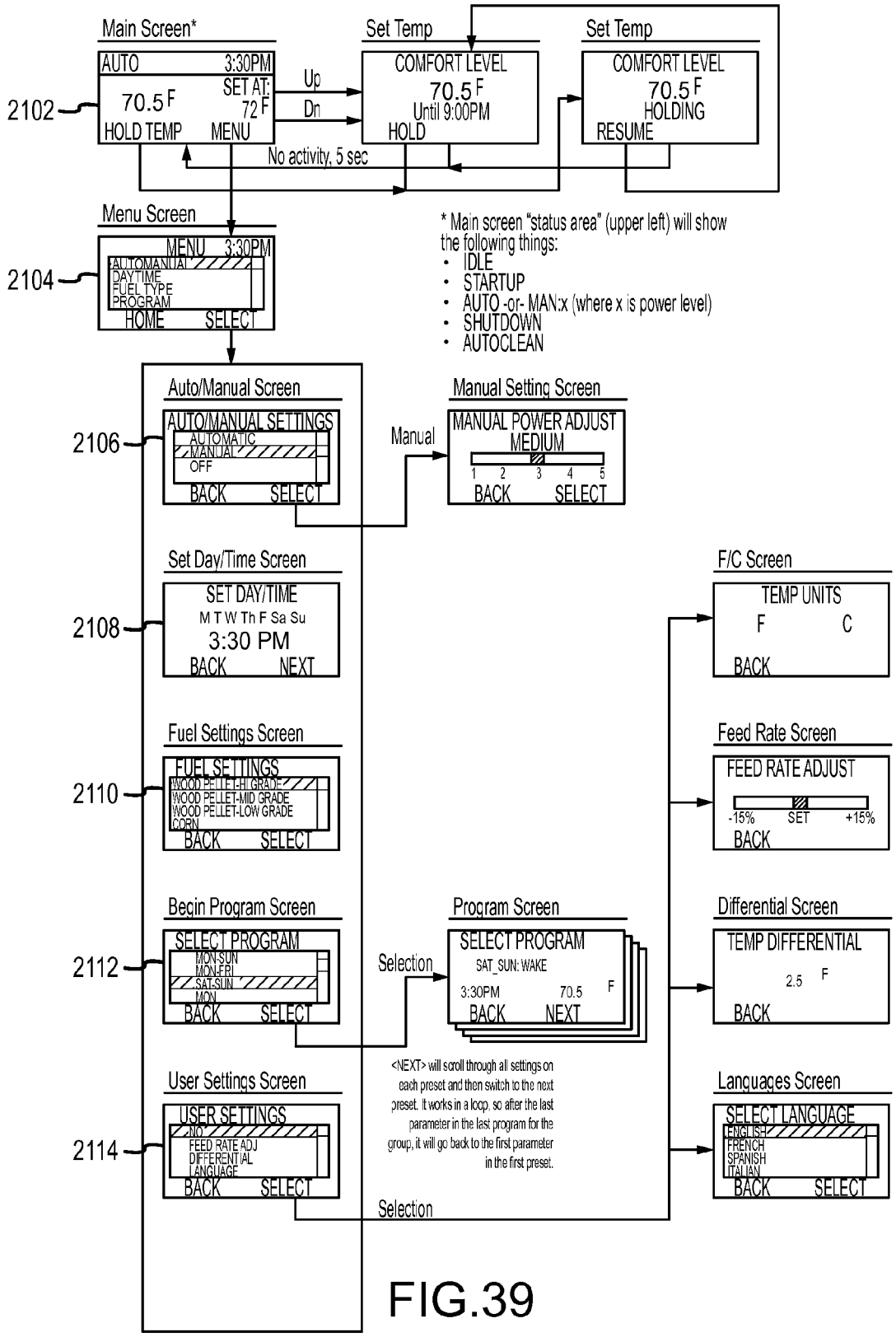
FIG. 39 illustrates exemplary user interface options according to embodiments of the present invention.

FIG. 39 illustrates exemplary user interface options available to the user through the wall control unit 1900. From the main screen 2102, the user can set the preferred temperature. In addition, the user can designate that the system "hold" the temperature at the selected temperature, regardless of any preprogrammed temperature schedules (discussed below).

At a menu screen 2104, the user selects from a menu of options, such as auto/manual, day/time, fuel type, program, or user settings. If the user selects auto/manual, an auto/manual screen 2106 will be displayed. Through the auto/manual screen 2106, the user can specify whether the system operate in a manual mode or automatic mode. In the manual mode, the system is either "on" or "off" in accordance with a selected manual power (e.g., levels 1-5). By contrast, in the automatic mode, the system automatically determines the manner of operation based on other parameters entered by the user.

Selecting day/time from the menu 2104 causes a "day/time" screen 2108 to be displayed, through which the user can set the day and time. If the user selects "fuel type" from the menu 2104, a fuel type screen 2110 is displayed through which the user selects the type of fuel that is in the hopper. The user can select from a number of different types of fuel (e.g., corn, wood pellet high grade, wood pellet medium grade, wood pellet low grade). The selected fuel will dictate various aspects of operation in automatic mode, such as, but not limited to, fuel feed rate.

If the user selects program from the menu 2104, a program screen 2112 is displayed. Through the program screen 2112, the user can program different temperatures for different days and times. If the user selects "user settings" from the menu 2104, a user settings screen 2114 is displayed at the wall unit 1900, which enables the user to go to other screens to enter various settings. In this embodiment, the user can enter the units for temperature (e.g., Fahrenheit or Celsius), the feed rate, a temperature differential, and a language. As such, the wall unit is multi-lingual.

Exemplary Operations

Figure 40:
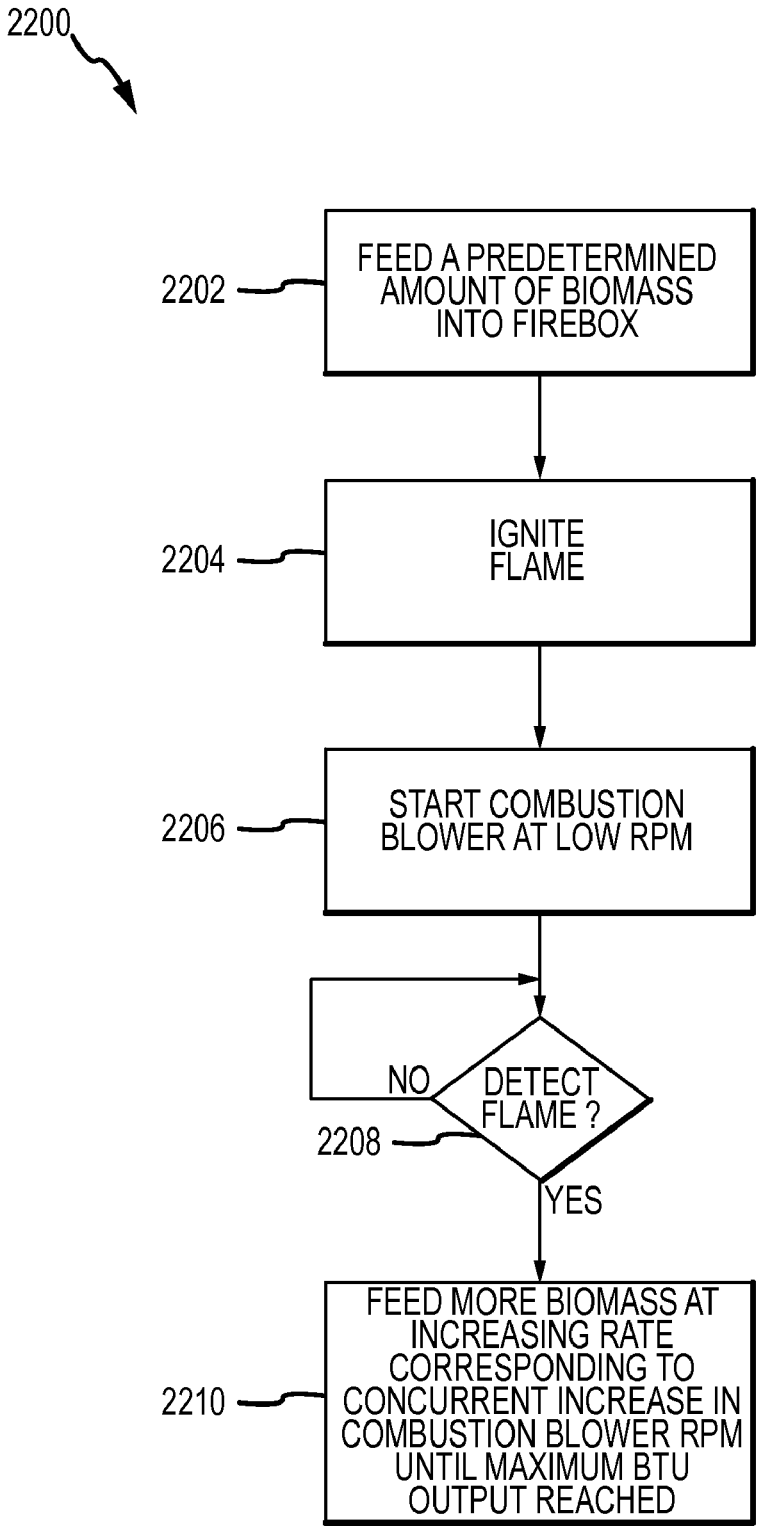
FIG. 40 illustrates a flow diagram depicting a slow start operation, according to embodiments of the present invention.
Figure 41:
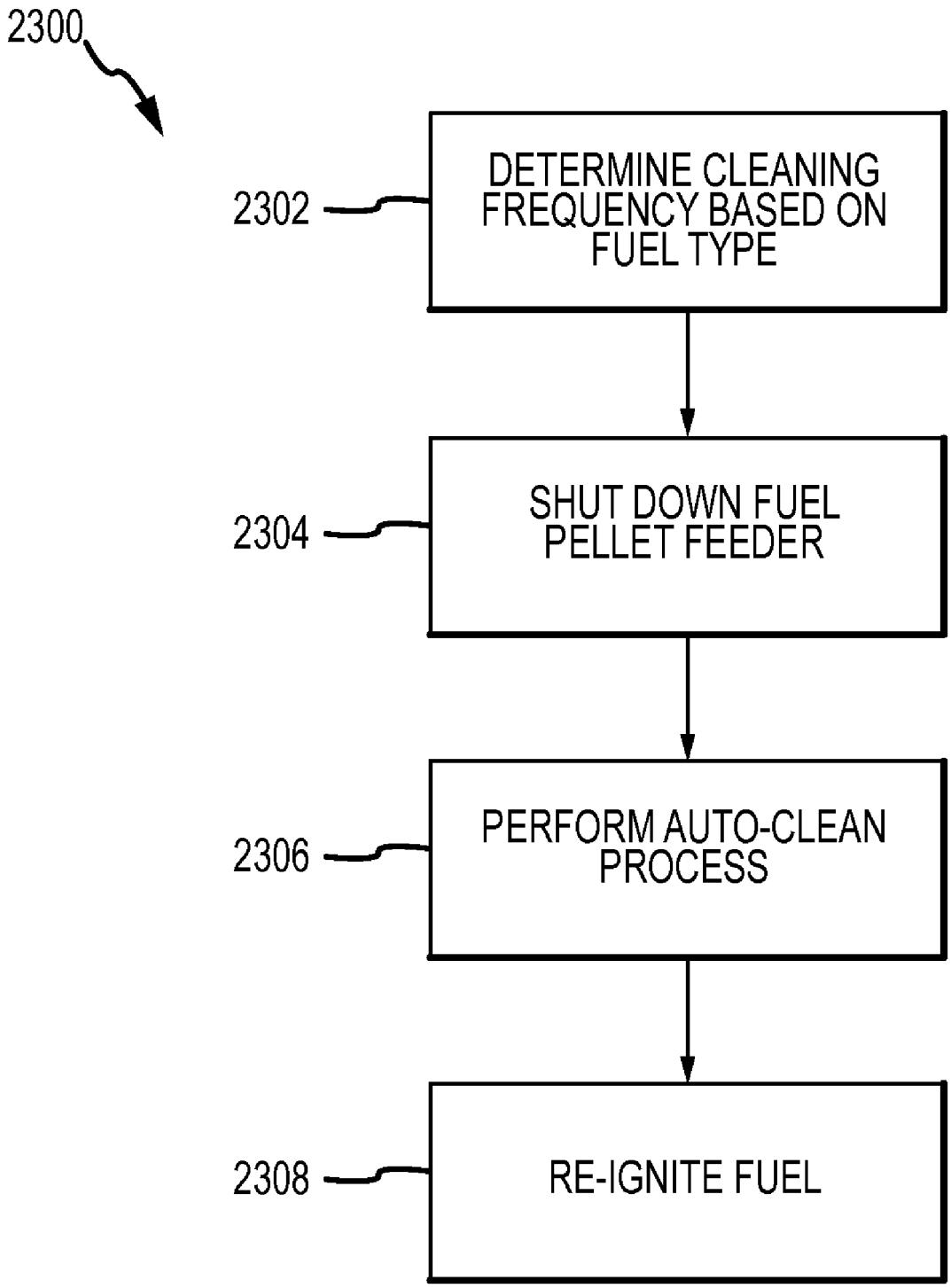
FIG. 41 illustrates a flow diagram depicting an auto clean operation, according to embodiments of the present invention.

Exemplary processes carried out by the stove control unit are illustrated in flow charts shown in FIGS. 40-44. FIG. 40 illustrates a "slow-start" algorithm 2200 for starting to burn a fuel, such as corn or other low grade fuel, which can be difficult to get started if the fuel is fed too quickly. FIG. 41 illustrates an auto-cleaning algorithm 2300 for determining the frequency of auto-cleaning and performing the auto-cleaning in a manner that is transparent to the user.

Beginning with FIG. 40, to begin the process of burning a fuel such as corn, the stove control unit executes a feeding operation 2202, which feeds a predetermined amount of biomass (e.g., corn) solid fuel into the firebox. The feeding operation 2202 involves determining the type of fuel and determining an associated specified amount of the fuel to be used during the burn start process. As discussed above, data tables in memory of the stove control unit 1716 can include the specified amount of fuel.

An igniting operation 2204 ignites the predetermined amount of fuel. In the igniting operation 2204 a signal is sent to the igniter to cause ignition. In a starting operation 2206, the stove control unit sends a signal to the combustion blower to begin blowing at a low rotational speed (e.g. RPM), which can be designated in parametric data tables in memory. The system then begins to slowly ignite the fuel in the firebox. A determining operation 2208 determines whether a flame is detected. In one embodiment, a thermocouple performs the determining operation 2208 by emitting an electrical signal when a certain temperature is present at a certain location.

After a flame is detected, another feeding operation 2210 begins feeding biomass into the firebox to cause the burn rate to increase. Also in the feeding operation 2210, the speed of the combustion blower is concurrently increased at a rate corresponding to the burn rate. As a result, the fuel feeding rate, burn rate, and combustion blower speed are increased together until the maximum energy output (e.g., British Thermal Unit (BTU)) or the desired or the predetermined energy output is reached. In a particular embodiment, the slow-start algorithm 2200 takes between ten and fifteen minutes.

Referring now to FIG. 41, an auto-cleaning algorithm 2300 is shown. In general, the firepot needs to be cleaned periodically. If not, the firepot will fill up with debris, which will clog the combustion holes in the firepot. If this continues without cleaning, the pellet stove will burn dirtier and dirtier and not keep up with the feed rate. Ultimately, without cleaning, the pellet stove will simply shut down. To avoid this situation, an automatic cleaning process that is fast and transparent to the user is provided.

Initially, in a determining operation 2302, the stove control unit determines a cleaning frequency based on fuel type. The determining operation 2302 can be performed by indexing a data structure that associates fuel type with cleaning frequency. For example, for corn, the cleaning frequency is around three hours when the system runs on high. Thus, sometime between two and three hours after starting to burn with corn, the system begins the cleaning process. In another embodiment, the auto-cleaning function may be triggered based on the number of heating cycles the pellet stove runs through.

Regardless of how the auto-cleaning function is triggered, in some embodiments, an icon will be displayed at a control panel (e.g., wall control unit 1714 user interface) which indicates that the cleaning function is necessary, or the cleaning function is being automatically performed. For example, the stove control unit 1716 can send a signal to the wall control unit 1714 that indicates that it is time for cleaning. If the icon indicates that the cleaning function is necessary, the control unit 1714 will enable the user to start the auto-cleaning function (e.g., by pressing a button, entering a command, or responding to a prompt). If the icon indicates that the cleaning function is being automatically performed, then the pellet stove, and specifically the stove control unit 1716 is causing the stove to be cleaned automatically, without the need for use input to trigger the process.

Throughout the auto-cleaning process, an icon may be displayed that indicates that the auto-cleaning process is occurring. In some embodiments, the icon can indicate a percentage of cleaning performed, or time until completion of auto-cleaning, or other related data.

Regardless of whether the auto-cleaning function begins automatically or is prompted by user input, the auto-cleaning process begins with shutting down the feeder 2304. In the shutting operation 2304, the stove control unit 1716 sends a signal to the feed motor 1706 that causes the auger of the feed tube chute 2700 to stop dispensing fuel. With the convection blower 1712 continuing the blow, the stove control unit 1716 sends a signal to the gear motor of the auto-clean assembly 1708 in a performing operation 2306. The gear motor 1708 then causes the firepot floor to open, thereby causing debris (e.g., ashes) in the firepot fall out. The gear motor 1708 then causes the floor to re-close.

The stove control unit 1716 then performs a re-igniting operation 2308, in which a signal is sent to the igniter 1704 to cause ignition. In various embodiments, the auto-cleaning algorithm 2300 can be performed in about five minutes, and can be completed before the convection blower 1712 turns off. As such, the process is transparent to the user.

Figure 42:
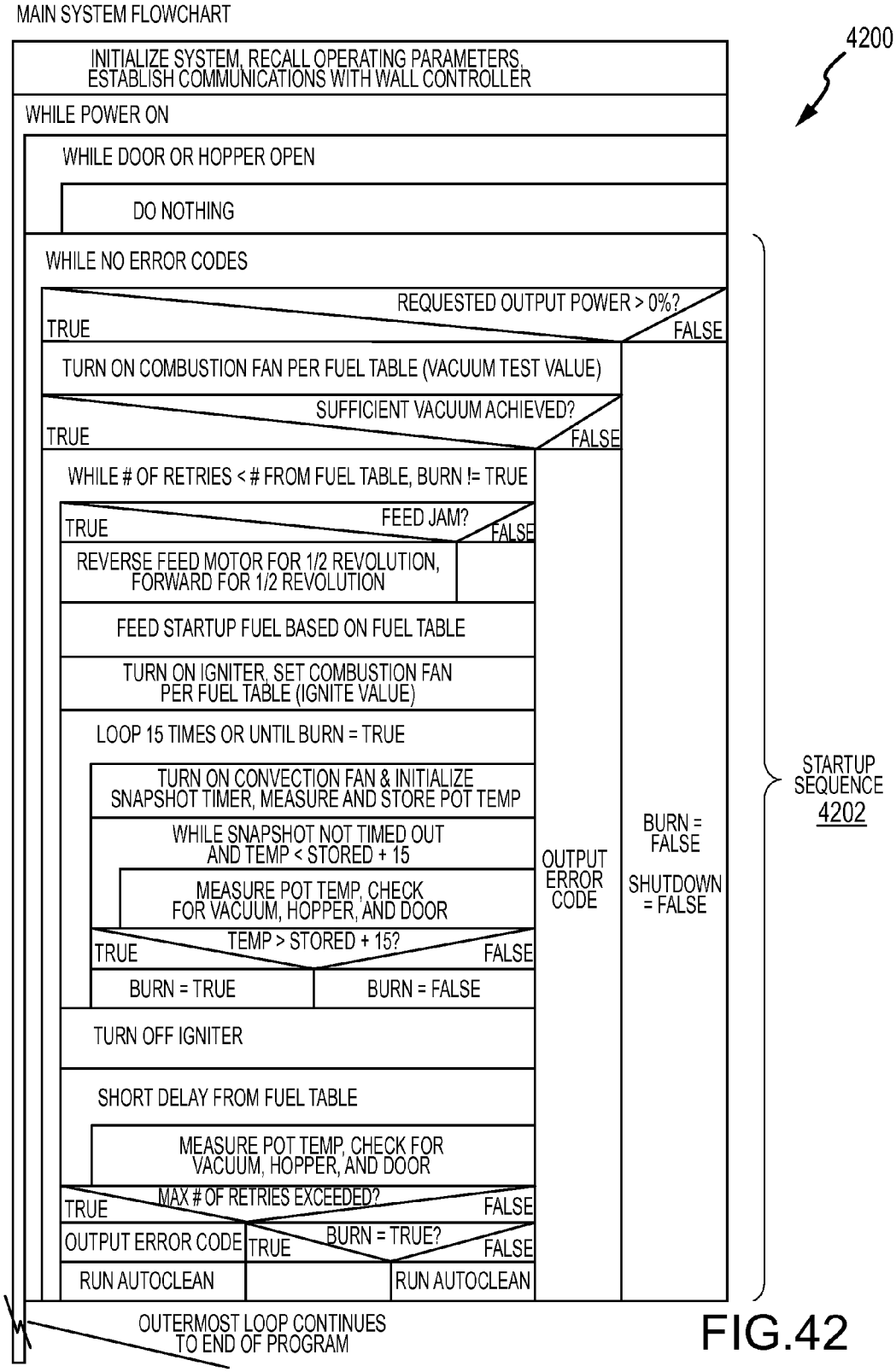
FIG. 42 illustrates a main system flow diagram depicting a startup sequence, according to embodiments of the present invention.
Figure 43:
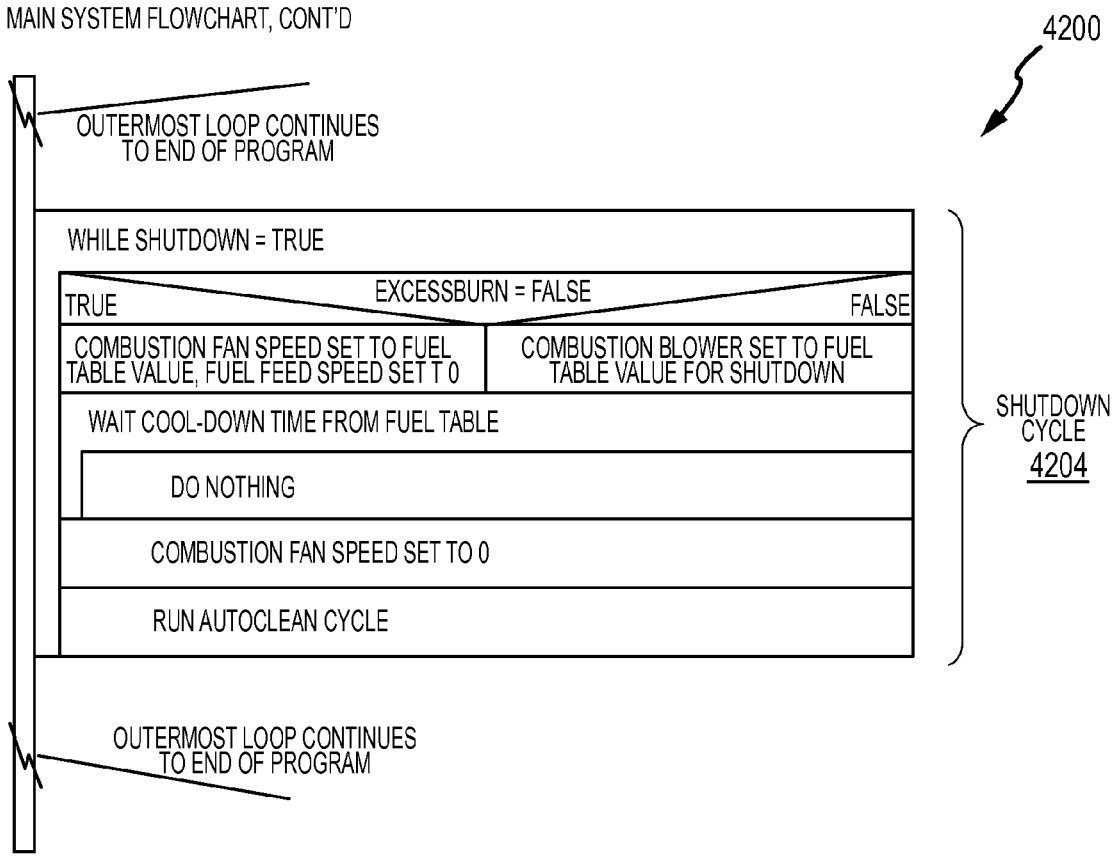
FIG. 43 illustrates the main system flow diagram of FIG. 42 depicting a shutdown cycle, according to embodiments of the present invention.
Figure 44:
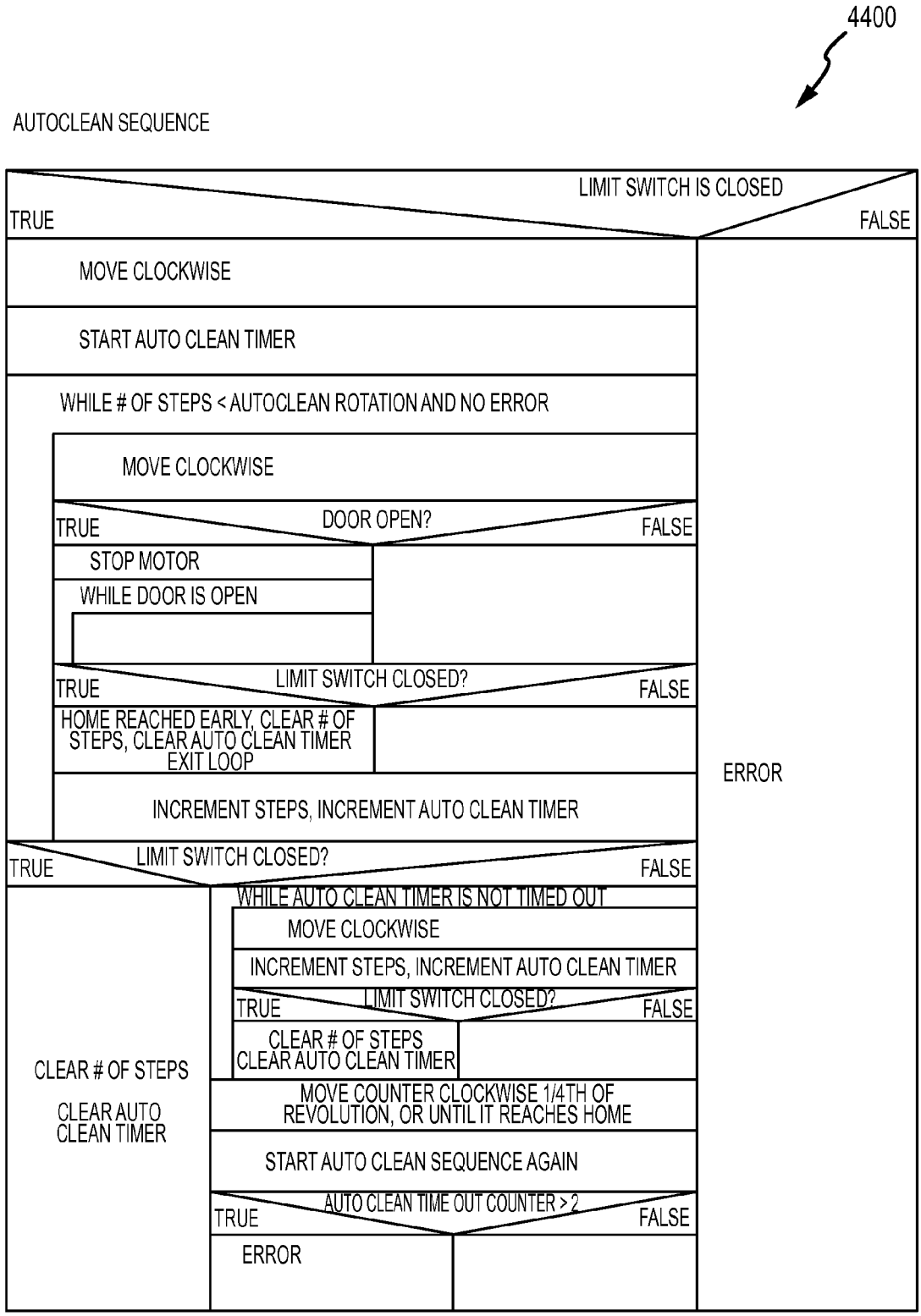
FIG. 44 illustrates an auto clean sequence flow diagram, according to embodiments of the present invention.

FIGS. 42-43 illustrate a main system flow chart 4200 according to embodiments of the present invention. The main system flow chart 4200 begins with FIG. 42, and continues with FIG. 43; FIG. 42 depicts exemplary operations in a startup sequence 4202, and FIG. 43 depicts exemplary operations in a shutdown cycle 4204, according to embodiments of the present invention. FIG. 44 illustrates an exemplary auto clean sequence flow chart 4400 according to embodiments of the present invention.

Embodiments of the present invention may be provided as a computer program product which may include a machine-readable medium having stored thereon instructions which may be used to program a computer (or other electronic devices) to perform a process according to the methodologies described herein. The machine-readable medium may include, but is not limited to, floppy diskettes, optical disks, CD-ROMs, and magneto-optical disks, ROMs, RAMs, EPROMs, EEPROMs, magnetic or optical cards, flash memory, or other type of media/machine-readable medium suitable for storing electronic instructions. Moreover, embodiments of the present invention may also be downloaded as a computer program product, wherein the program may be transferred from a remote computer to a requesting computer by way of data signals embodied in a carrier wave or other propagation medium via a communication link (e.g., a modem or network connection).

The tables shown and described herein are for illustrative purposes only in order to illustrate how one skilled in the art could create a data structure in accordance with various embodiments. In particular embodiments, data structures are not limited to those illustrated by the tables. It will be understood that values in an application product-specific script components data structure are not limited to those shown in tables described herein. In addition, the arrangement of values is not limited to the arrangements shown in the tables.

The functional modules, systems, operations, and data structures discussed herein are capable of combination, separation, or any other type of rearrangement without departing from the spirit scope of the claims recited below. For example, the notification service may be combined with the service provider or the intelligent message delivery system. Data structures shown and described can be implemented in any format known to those skilled in the art including, but not limited to extensible markup language (XML), as entries in a relational database, or any proprietary format.

Although some exemplary methods, systems, and devices have been illustrated in the accompanying drawing and described in the foregoing detailed description, it will be understood that the methods and systems shown and described are not limited to the particular embodiments described herein, but rather are capable of numerous rearrangements, modifications, and substitutions without departing from the scope and spirit of the claims set forth below.

We claim:

1. A firepot assembly for a pellet stove, comprising:

a combustion enclosure configured to house a solid fuel during combustion, the combustion enclosure comprising a first opening configured to receive the solid fuel and a second opening through which the solid fuel may be released after combustion, wherein the second opening comprises a bottom opening and a partial side opening having an angled portion with respect to the bottom opening;

a first rail;

a second rail;

a bottom plate configured to slide along the first rail and the second rail between a closed position in which the bottom plate substantially covers the second opening and an open position in which the bottom plate does not cover the second opening, wherein the bottom plate has a first portion that slides with respect to the first rail and a second portion that slides with respect to the second rail, and wherein the second portion has a different elevation with respect to the first portion; and a motor coupled to the bottom plate and configured to move the bottom plate between the closed position and the open position.

2. The firepot assembly of claim 1, wherein the bottom plate comprises a substantially flat portion configured to abut the bottom opening and a ramped portion configured to abut the partial side opening.

3. The firepot assembly of claim 1, further comprising a controller communicably coupled to the motor and configured to activate the motor at predetermined time intervals.

4. The firepot assembly of claim 1, further comprising a controller configured to receive information about the solid fuel, calculate a cleaning interval based on the information, and activate the motor after the cleaning interval based on the calculation.

5. The firepot assembly of claim 1, wherein the motor comprises a drive shaft, and wherein the drive shaft extends through a crank arm having a cam roller, the firepot assembly further comprising a lever arm pivotally mounted to a stationary pivot bracket, wherein the lever arm includes a channel at a distal end for receiving the cam roller, wherein a proximate end of the lever arm is pivotally connected to a plow arm coupled to a lower surface of the bottom plate, and wherein actuation of the crank arm causes the lever arm to pull the plow arm and move the bottom plate to the open position.

6. A pellet stove control system comprising:

a wall control unit providing a user interface through which a user sets one or more parameters related to operation of the pellet stove, wherein at least one of the parameters is a fuel type; and a stove control unit communicably coupled with the wall control unit, the stove control unit receiving the one or more parameters from the wall control unit and automatically controlling fuel feed rate, ignition, convection blower, combustion blower, and firepot cleaning of the pellet stove, based at least in part on the one or more parameters, wherein the stove control unit comprises a machine-readable medium, the machine-readable medium containing instructions executable by the stove control unit to:

receive information about a fuel type; and determine a cleaning frequency based on the fuel type, wherein the cleaning frequency occurs automatically or manually, and wherein the manually operated cleaning frequency is transmitted from the stove control unit to the wall control unit.

7. The pellet stove control system of claim 6, wherein the one or more parameters are selected from a group consisting of: temperature, time of day, day of week, fuel type, automatic mode, and manual mode.

8. The pellet stove control system of claim 6, wherein the machine-readable medium further contains instructions executable by the stove control unit to:

feed a predetermined amount of biomass fuel into the firepot;

ignite the biomass fuel;

start the combustion blower;

detect a flame for the biomass fuel; and based at least in part on the detection, feed additional amounts of the biomass fuel into the firepot at an increasing rate while concurrently increasing a speed of the combustion blower until a predetermined heat output is achieved.

9. The pellet stove control system of claim 6, wherein the machine-readable medium further contains instructions executable by the stove control unit to:

initiate an auto clean process based on the cleaning frequency; and re-ignite the fuel.

10. The pellet stove control system of claim 6, further comprising a memory, the memory comprising parametric data for one or more fuel types, the parametric data for each of the one or more fuel types including one or more fixed parameters selected from the group consisting of: feed rate, auger speed, combustion fan speed, minimum temperature during burn, maximum temperature during burn, soft start low feed speed, soft start feed speed, soft start feed time, soft start blower speed, rise temperature during soft start, pot temperature after soft start, maximum number of ignition retries, auto clean pulse interval, start up feed charge speed, ignition time, snapshot time, snapshot temperature rise differential, cool down time, start up vacuum test combustion blower speed, start up ignition combustion blower speed, shutdown combustion blower speed, vacuum pressure threshold, drop tube maximum temperature, and power table data.

11. The firepot assembly of claim 1, wherein the bottom plate comprises a first portion configured to abut the bottom opening and a second portion configured to abut the partial side opening.

12. A firepot assembly for a pellet stove, comprising:

a combustion enclosure configured to house a solid fuel during combustion, the combustion enclosure comprising a first opening configured to receive the solid fuel and a second opening through which the solid fuel may be released after combustion, and wherein the second opening comprises a bottom opening and a partial side opening having an angled portion with respect to the bottom opening, wherein the first opening and the second opening are the only openings in the combustion enclosure large enough to release solid fuel portions after combustion;

a first rail;

a second rail;

a bottom plate configured to slide along the first rail and the second rail between a closed position in which the bottom plate substantially covers the second opening and an open position in which the bottom plate does not cover the second opening, wherein the bottom plate has a first portion that slides with respect to the first rail and a second portion that slides with respect to the second rail, and wherein the second portion has a different elevation with respect to the first portion; and a motor coupled to the bottom plate and configured to move the bottom plate between the closed position and the open position.

13. The firepot assembly of claim 12, wherein the first and second openings are the only openings in the combustion enclosure.

14. The firepot assembly of claim 12, wherein the first portion of the bottom plate is configured to about the bottom opening and the second portion of the bottom plate is configured to abut the partial side opening.

15. The firepot assembly of claim 12, wherein the bottom plate comprises a substantially flat portion configured to abut the bottom opening and a ramped portion configured to abut the partial side opening.

* * * * *

UNITED STATES PATENT AND TRADEMARK OFFICE

CERTIFICATE OF CORRECTION

PATENT NO. : 8,082,915 B2
APPLICATION NO. : 12/414475
DATED : December 27, 2011
INVENTOR(S) : Colin J. McCormick et al.

It is certified that error appears in the above-identified patent and that said Letters Patent is hereby corrected as shown below:

Column 18, line 26 should read: portion of the bottom plate is configured to [[about] abut the bottom Signed and Sealed this
Fifteenth Day of May, 2012

David J. Kappos

David J. Kappos
*Director of the United States Patent and Trademark Office*